US008816945B2

(12) United States Patent
Kasai et al.

(10) Patent No.: US 8,816,945 B2
(45) Date of Patent: Aug. 26, 2014

(54) DISPLAY APPARATUS

(75) Inventors: Naruhiko Kasai, Yokohama (JP); Hiroki Awakura, Yokohama (JP); Toshihiro Satou, Mobara (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1461 days.

(21) Appl. No.: 11/783,603

(22) Filed: Apr. 10, 2007

(65) Prior Publication Data

US 2007/0188423 A1 Aug. 16, 2007

Related U.S. Application Data

(63) Continuation of application No. 10/633,645, filed on Sep. 17, 2003.

(51) Int. Cl.
*G09G 3/30* (2006.01)

(52) U.S. Cl.
USPC ..... 345/78; 345/76

(58) Field of Classification Search
USPC ..... 345/76–83
See application file for complete search history.

(56) References Cited

U.S. PATENT DOCUMENTS

| | | | | |
|---|---|---|---|---|
| 6,291,942 | B1 | 9/2001 | Odagiri et al. | |
| 6,339,414 | B1 * | 1/2002 | Todokoro et al. | 345/75.1 |
| 6,384,804 | B1 * | 5/2002 | Dodabalapur et al. | 345/82 |
| 7,173,612 | B2 * | 2/2007 | Nanno et al. | 345/211 |
| 2003/0011545 | A1 | 1/2003 | Sagano et al. | |

FOREIGN PATENT DOCUMENTS

| | | |
|---|---|---|
| JP | 10-223373 | 8/1998 |
| JP | 2000-187467 A | 7/2000 |
| JP | 2000-194428 A | 7/2000 |

* cited by examiner

*Primary Examiner* — Claire X Pappas
*Assistant Examiner* — Duane N Taylor, Jr.
(74) *Attorney, Agent, or Firm* — Antonelli, Terry, Stout & Kraus, LLP.

(57) ABSTRACT

The present invention comprises: a display unit having a plurality of display elements arranged in a matrix; a drive voltage generating circuit for generating a drive voltage for driving the plurality of display elements; a dataline drive circuit for generating a signal voltage according to display data, the signal voltage being for controlling the amount of current in a supply line of the drive voltage; a scanline drive circuit for selecting one or more of the plurality of display elements which is to be driven; and a pixel light emission control circuit for controlling a light emission time period of each display element according to a distance measured along a current path from the drive voltage generating circuit to the display element.

8 Claims, 14 Drawing Sheets

DISPLAY APPARATUS

CROSS REFERENCE TO RELATED APPLICATION

This application is a Continuation of U.S. application Ser. No. 10/663,645, filed Sep. 17, 2003, the contents of which are incorporated herein by reference.

JP-A-10-223373 discloses a display in which the cathode electrode patterns are formed such that the odd-numbered ones lead to one side of the substrate and the even-numbered ones lead to the opposite side in order to provide a uniform luminance distribution over the entire screen.

JP-A-2000-194428 discloses a device for driving organic EL elements, which employs a plurality of current sources (for example, 5 current sources) for each organic EL element and can change the current flowing in each organic EL element through selection control of the current sources so as to prevent occurrence of uneven luminance distribution due to variations among the current sources and among the forward voltages of the organic EL elements. The above JP-A-2000-194428 also discloses a technique for adjusting the luminance of each organic EL element by adjusting its light emission time period.

JP-A-2000-187467 discloses a technique for detecting the current flowing through each organic EL element by use of a current detecting circuit and controlling the next light emission time period of the element based on the detected current value, making it possible to detect and correct luminance variations among the elements due to variations among the original characteristics of the elements or degradation of the elements and thereby provide favorable gray scale control.

U.S. Pat. No. 6,291,942 (JP-A-2001-13903) discloses a technique for detecting the degradation degree of each light-emitting element based on the value of its current or luminance or a time characteristic to generate degradation information, and adjusting the time period during which a constant voltage is applied to the light-emitting element or no constant voltage is applied based on the generated degradation information.

The invention described in the above JP-A-10-223373 is disadvantageous in that high-luminance and low-luminance lines are alternately produced near each edge of the screen, and therefore an uneven luminance distribution may occur. Furthermore, since the current flowing through each light-emitting element varies according to its luminance, the amount of supply current changes depending on the number of pixels actually emitting light. That is, the amount of reduction in the luminance of each pixel due to the supplied current depends on the display data. The above JP-A-10-223373 takes into account that a voltage drop occurs between a light-emitting dot near the lead-out portion of the electrode pattern and that far from the portion. However, it gives no consideration to the fact that the amount of reduction in the luminance of each pixel due to the supplied current varies depending on the display data.

The invention described in the above JP-A-2000-194428 prevents occurrence of uneven luminance distribution due to variations among the current sources and among the forward voltages of the organic EL elements. However, this patent application gives no consideration to how to reduce the decrease in the luminance of each display element due to the voltage drop across the wiring from the current source to the display element or reduce occurrence of uneven luminance distribution due to luminance reduction variations among the display elements.

The above JP-A-2000-194428, JP-A-2000-187467, and U.S. Pat. No. 6,291,942 (JP-A-2001-13903) only correct luminance variations among the display elements due to variations among the original characteristics of the elements or degradation (secular change) of the elements. They give no consideration to how to reduce the decrease in the luminance of each display element due to the voltage drop across the wiring from the current source to the display element or reduce occurrence of uneven luminance distribution due to luminance reduction variations among the display elements.

SUMMARY OF THE INVENTION

An object of the present invention is to provide a display apparatus which exhibits a reduced degree of unevenness of the display luminance due to positional differences among the display elements.

Another object of the present invention is to provide a display apparatus which exhibits a reduced degree of unevenness of the display luminance due to the voltage drop across the wiring from each current source to each display element.

The present invention controls the light emission time period (drive time period) of each display element based on the distance of the display element from the drive voltage generating circuit which generates a drive voltage for driving each display element.

Since the display elements are disposed in a matrix, the distance from the drive voltage generating circuit to each display element depends on the location of the display element. Therefore, the present invention changes the light emission time period of each display element according to its position.

The present invention can reduce the degree of unevenness of the display luminance due to positional differences among the display elements.

The present invention also can reduce the degree of unevenness of the display luminance due to the voltage drop across the wiring from each current source to each display element.

DETAILED DESCRIPTION OF THE PREFERRED EMBODIMENTS OF THE INVENTION

A first embodiment of the present invention will be described in detail below with reference to the accompanying drawings.

Figure 1:
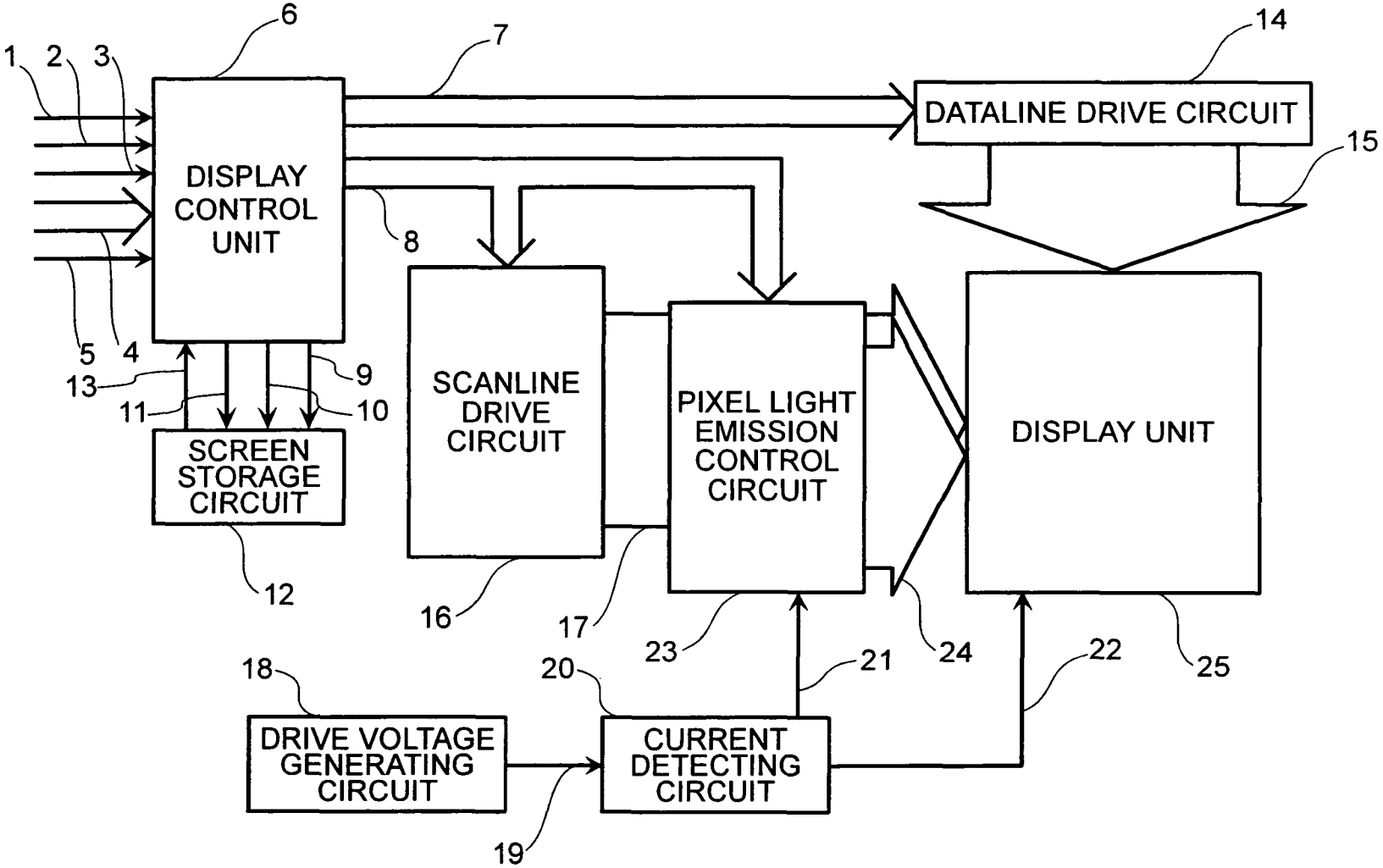
FIG. 1 is a diagram showing the configuration of a display apparatus according to a first embodiment of the present invention.

FIG. 1 is a diagram showing the configuration of a display apparatus according to the first embodiment of the present invention. A vertical sync signal 1 has a period of one display screen (that is, one frame); a horizontal sync signal 2 has a period of one horizontal line; and a data enable signal 3 indicates a valid or invalid period for display data 4 (display valid period). All of these signals are entered from an external device such as a personal computer in synchronization with a synchronous clock 5. The first embodiment assumes that the display data is transmitted in raster scan format as a series of pixels starting with the top left pixel for each screen, and each piece of pixel information consists of 4 bits of gray scale data. Reference numeral 6 denotes a display control unit; 7, dataline control signals; 8, scanline control signals; 9, a read/write command signal; 10, a read/write address; 11, data to be written, or stored; 12, a screen (data) storage circuit; and 13, read screen data. The display control unit 6 generates the read/write command signal 9, the read/write address 10, and data to be written 11 to temporarily store the data to be written 11 in the screen storage circuit (frame memory) 12, which can store at least an amount of display data 4 equivalent to one screen of a display unit 25 (described later). The display control unit 6 also generates the read/write command 9 and the read/write address 10 to read out one screen of display data at the display timing of the display unit 25. The screen storage circuit 12 reads out the screen data 13 or stores the data to be written 11 according to the read/write command signal 9 and the read/write address 10. The display control unit 6 generates the dataline control signals 7 and the scanline control signals 8 from the read screen data 13. Reference numeral 14 denotes a dataline drive circuit; 15, dataline drive signals; 16, a scanline drive circuit; 17, scanline drive signals; 18, a drive voltage generating circuit; 19, a drive reference voltage; 20, a current detecting circuit; 21, current detection information; 22, a drive voltage; 23, a pixel light emission control circuit; 24, pixel light emission control signals; 25, a light-emitting element display. The display unit 25 has light-emitting elements, such as light emitting diodes or organic EL elements, as its display elements. The plurality of light-emitting elements (pixels) of the display unit 25 are arranged in a matrix. The pixel light emission control is such that signal voltages determined according to the dataline drive signals 15 output from the dataline drive circuit 14 are applied to the pixels selected by the scanline drive signals 17 output from the scanline drive circuit 16, and the light emission of each pixel is controlled according to the pixel light emission control signals 24 output from the pixel light emission control circuit 23. At that time, the current detecting circuit 20 detects the amount of current in the drive voltage 22 supply line and outputs this information as the current detection information 21. The pixel light emission control circuit 23 outputs the pixel light emission control signals 24 according to the scanline control signals 8 and the current detection information 21 to control the light emission time period of each pixel. The drive voltage 22 is supplied to drive the light emitting elements. It should be noted that the scanline drive circuit 16 and the pixel light emission control circuit 23 may be implemented on a single LSI chip. The first embodiment assumes that the display unit 25 has a resolution of 640×480 dots. The display unit 25 can adjust the luminance of each light-emitting element by changing the amount of current flowing in the element or the light emission time period of the element. The larger the amount of current flowing in a light-emitting element, the higher the luminance of the element. Furthermore, the longer the light emission time period of the element, the higher its luminance. The dataline drive circuit 14 generates signal voltages according to the display data; the signal voltages are used to control the amount of current supplied to the light-emitting elements through the drive voltage line.

Figure 2:
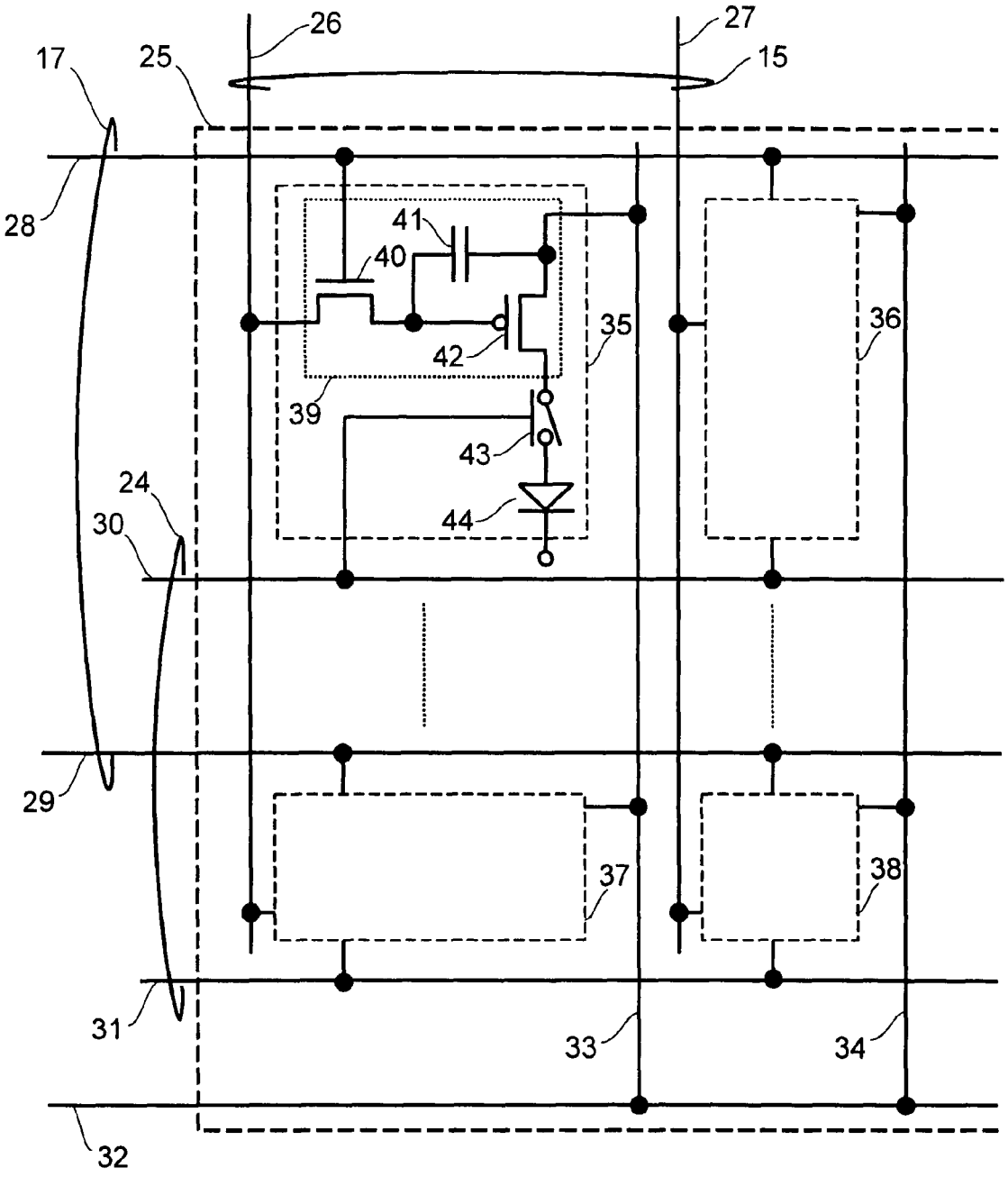
FIG. 2 is a diagram showing the configuration of a display unit 25 according to the first embodiment of the present invention.

FIG. 2 shows the internal configuration of the display unit 25 according to the first embodiment of the present invention. In this example, the display unit 25 uses organic EL elements as its light-emitting elements. In the figure, reference numeral 26 denotes a first dataline; 27, a second dataline; 28, a first scanline; 29, a $480^{th}$ scanline; 30, a first light emission control line; 31, a $480^{th}$ light emission control line; 32, an organic EL drive voltage supply line; 33, a first-column organic EL drive voltage supply line; 34, a second-column organic EL drive voltage supply line; 35, a first-row first-column pixel; 36, a first-row second-column pixel; 37, a $480^{th}$-row first-column pixel; and 38, a $480^{th}$-row second-column pixel. Signal voltages are applied through the datalines to the pixels in the row selected by one of the scanline selection voltages applied to the scanlines. The pixels to be caused to emit light are selected through the light emission control lines. The organic EL drive voltage supplied through each column-wise organic EL drive voltage supply line is controlled according to the signal voltages so as to cause each pixel to emit light. FIG. 2 only shows the internal configuration of the first-row first-column pixel 35. However, the first-row second-column pixel 36, the $480^{th}$-row first-column pixel 37, and the $480^{th}$-row second-column pixel 38 also have the same internal configuration. Reference numeral 39 denotes a pixel drive unit; 40, a switching transistor; 41, a write capacitance (storage capacitance); 42, a drive transistor; 43, a light emission control switch; and 44, an organic EL element. The pixel drive unit 39 controls the current in the organic EL 44 according to the signal voltage. The pixel drive unit 39 comprises the switching transistor 40, the write capacitance 41, and the drive transistor 42. The switching transistor 40 is turned on by a signal on the first scanline 28, storing on the write capacitance the signal voltage supplied through the first dataline 26. The stored voltage is used to control the amount of current flowing through the drive transistor 42. The current controlled by the drive transistor 42 flows through the organic EL 44 during the light emission time period determined by the operation of the light emission control switch 43, causing the organic EL 44 to emit light whose luminance corresponds to the amount of the current. The present embodiment assumes that the light emission control switch 43 is turned on when the control signal is set to the High level, conducting the current therethrough, whereas it is turned off when the control signal is set to the Low level, cutting off the current. It should be noted that the above relationship may be reversed.

The display unit 25 has 640×480 pixels. Therefore, 480 horizontal scanlines, from the first scanline 28 to the $480^{th}$ scanline 29, are vertically aligned with one another, and 640 vertical datalines, from the first dataline 26 and the second dataline 27 to the $640^{th}$ dataline, are horizontally aligned with one another. The organic EL drive voltage supply line 32 is disposed along the bottom of the display unit 25. The following description assumes that 640 vertical (column-wise) lines (for example, the first-column organic EL drive voltage supply line 33, the second-column organic EL voltage supply line 34, etc.) are connected with the organic EL drive voltage supply line 32 in the horizontal (row) direction. Accordingly, the drive voltage is supplied from the organic EL drive voltage supply line 32 to the pixels arranged in a matrix through the first-column organic EL drive voltage supply line 33, the second-column organic EL drive voltage supply line 34, etc. such that the voltage is applied to each column (or each plurality of columns) of pixels together in the direction from the bottom to the top of the display unit 25. Assuming that each organic EL 44 has the same light emission time period, the lower pixels in each column (the pixels located near the drive voltage supply point) have a relatively high display luminance level, while the upper pixels in each column (the pixels located far from the drive voltage supply point) have a relatively low display luminance level, making it necessary to control the light emission time period of each organic EL 44. It should be noted that the organic EL drive voltage supply line 32 may be disposed along the top of the display unit 25. In such a case, the drive voltage is supplied from the organic EL drive voltage supply line 32 disposed along the top to the pixels arranged in a matrix through the first-column organic EL drive voltage supply line 33, the second-column organic EL drive voltage supply line 34, etc. such that the voltage is applied to each column (or each plurality of columns) of pixels together in the direction from the top to the bottom of the display unit 25. Assuming that each organic EL 44 has the same light emission time period, the upper pixels in each column (the pixels located near the drive voltage supply point) have a relatively high display luminance level, while the lower pixels in each column (the pixels located far from the drive voltage supply point) have a relatively low display luminance level. Further, two organic EL drive voltage supply lines 32 may be employed, one disposed along the top of the display unit 25 and the other along the bottom. In this case, the drive voltage may be supplied from the top and the bottom of the display unit 25, alternately, to each column of pixels. Still further, the organic EL drive voltage supply line 32 may be disposed along the right side of the display unit 25. In such a case, 480 horizontal (for example, the first-row organic EL drive voltage supply line, the second-row organic EL voltage supply line, etc.) are connected with the organic EL drive voltage supply line 32 in the vertical direction. Accordingly, the drive voltage is supplied from the organic EL drive voltage supply line 32, disposed along the right side, to the pixels arranged in a matrix through the first-row organic EL drive voltage supply line, the second-row organic EL drive voltage supply line, etc. such that the voltage is applied to each row (or each plurality of rows, e.g., 2 or 3 rows) of pixels together in the direction from the right side to the left side of the display unit 25. Therefore, assuming that each organic EL 44 has the same light emission time period, the right pixels in each row (the pixels located near the drive voltage supply point) have a relatively high display luminance level, while the left pixels in each row (the pixels located far from the drive voltage supply point) have a relatively low display luminance level. Still further, the organic EL drive voltage supply line 32 may be disposed along the left side of the display unit 25. In this case, the drive voltage is supplied from the organic EL drive voltage supply line 32, disposed along the left side, to the pixels arranged in a matrix through the first-row organic EL drive voltage supply line, the second-row organic EL drive voltage supply line, etc. such that the voltage is applied to each row (or each plurality of rows, e.g., 2 or 3 rows) of pixels together in the direction from the left side to the right side of the display unit 25. Therefore, assuming that each organic EL 44 has the same light emission time period, the left pixels in each row (the pixels located near the drive voltage supply point) have a relatively high display luminance level, while the right pixels in each row (the pixels located far from the drive voltage supply point) have a relatively low display luminance level. Furthermore, two organic EL drive voltage supply lines 32 may be employed, one disposed along the left side of the display unit 25 and the other disposed along the right side. In this case, the drive voltage may be supplied from the left side and the right side of the display unit 25, alternately, to each row of pixels.

Figure 3:
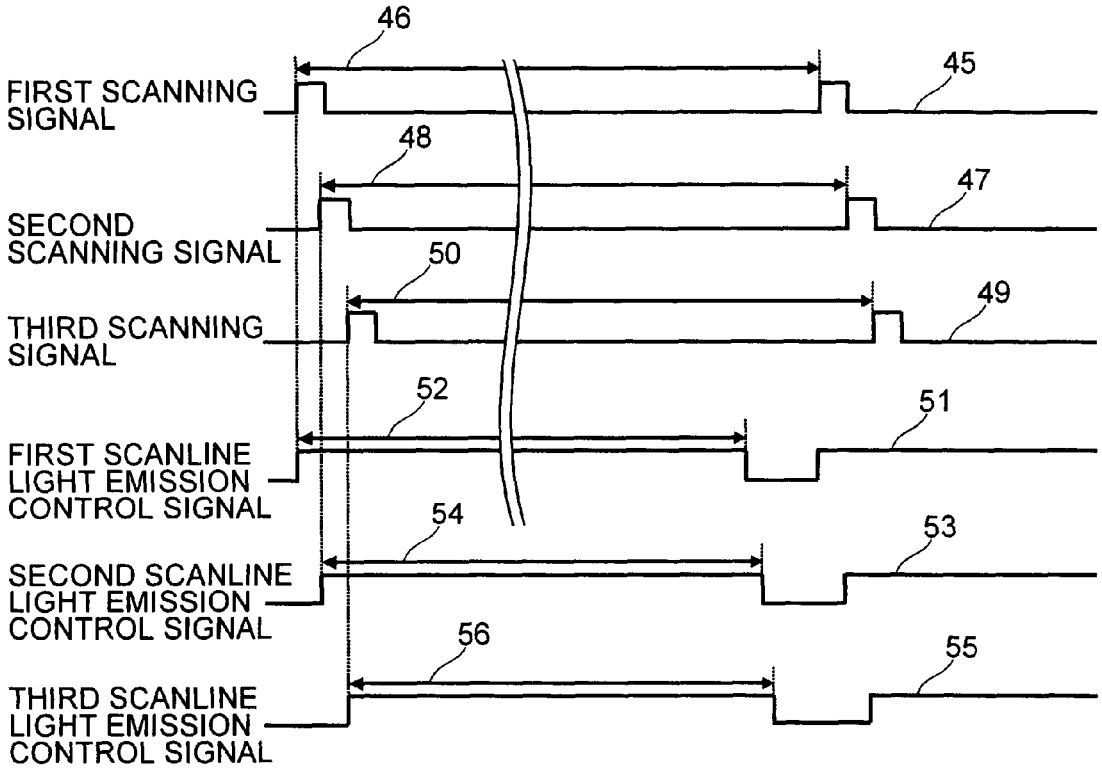
FIG. 3 is a diagram showing a scanline drive signal 17 and a pixel light emission control signal 24 for each scanline according to the first embodiment of the present invention.

FIG. 3 is a diagram showing a scanline drive signal and a pixel light emission control signal for each scanline according to the first embodiment of the present invention. In the figure, reference numeral 45 denotes a first scanline signal; 46, a first scanline drive cycle period; 47, a second scanline signal; 48, a second scanline drive cycle period; 49, a third scanline signal; 50, a third scanline drive cycle period; 51, a first scanline light emission control signal; 52, a first scanline light emission period; 53, a second scanline light emission control signal; 54, a second scanline light emission period; 55, a third scanline light emission control signal; and 56, a third scanline light emission period. Each scanline signal is sequentially given such that the second scanline signal 47 is input after termination of the first scanline signal 45, the third scanline signal 49 is input after termination of the second scanline signal 47, and so on. Therefore, the first scanline drive cycle period 46, the second scanline drive cycle period 48, and the third scanline drive cycle period 50 are periods during which the signal voltages are applied. There are 480 scanline drive cycle periods (from the first scanline drive cycle period 46 to the $480^{th}$ scanline drive cycle period). All of these scanline drive cycle periods are preferably set to a same value. Each scanline light emission control signal is set to the High level after the corresponding scanline signal has risen, and then set to the Low level after a certain period of time but before the corresponding scanline signal rises again for the next write cycle. Each pixel emits light only while the scanline light emission control signal is set at the High level. However, it may be arranged that each pixel emits light only while the scanline light emission control signal is set at the Low level. The above period (the light emission period) can be set for each scanline. Therefore, the first scanline light emission period 52, the second scanline light emission period 54, and the third scanline light emission period 56 may be each set to a different value. It should be noted that the scanline signals may be given sequentially one after another or in units of a plurality of (e.g., two or three) scanline signals.

Figure 4A:
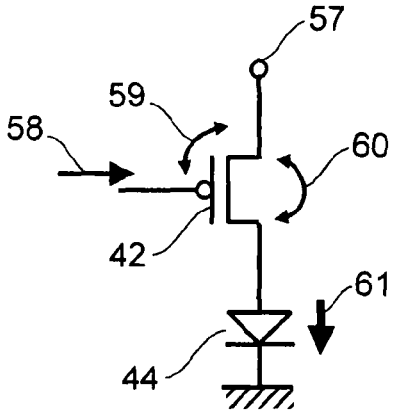
FIG. 4 (including FIGS. 4A and 4B) is a conceptual diagram illustrating current control according to the first embodiment of the present invention.
Figure 4B:
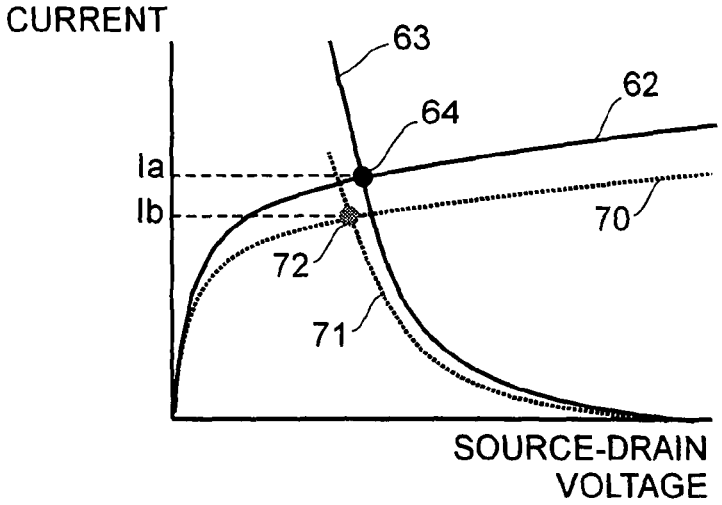

FIG. 4A is a diagram showing the configuration of only a drive transistor and an organic EL according to the first embodiment of the present invention. FIG. 4B is a diagram showing the relationship between the signal voltage and the current. Reference numeral 57 denotes an organic EL drive voltage; 58, a write voltage; 59, a source-gate voltage; 60, a source-drain voltage; and 61, an organic EL current. The drive transistor 42 controls the organic EL current 61 and causes the organic EL 44 to emit light according to the relation between the source-gate voltage 59 and the source-drain voltage 60 determined by the organic EL voltage 57 and the write voltage 58. Reference numeral 62 denotes a drive transistor voltage-current characteristic; 63, an organic EL voltage-current characteristic; and 64, an organic EL operating point. In the drive transistor voltage-current characteristic 62, the horizontal axis indicates the value of the source-drain voltage 60 of the drive transistor 42 and the vertical axis indicates the current flowing through the drive transistor 42. This characteristic is obtained with the source-gate voltage 59 set to a fixed value, that is, when the value of the signal voltage 58 is set to a certain value. The organic EL voltage-current characteristic 63 is obtained with the organic EL drive voltage 57 set to a fixed value. In this characteristic, the horizontal axis indicates the value of the source-drain voltage 60 and the vertical axis indicates the value of the organic EL current 61 determined by the organic EL voltage which is the difference between the organic EL drive voltage 57 and the source-drain voltage 60. Therefore, the organic EL operating point 64, which is the intersection point of the two characteristic curves, indicates the value of the organic EL current 61 obtained when the organic EL drive voltage 57 and the signal voltage 58 are set to certain values. In FIG. 4B, the source-drain voltage characteristic (drive transistor voltage-current characteristic) of the drive transistor 42 with the signal voltage 58 set to a certain value is overlapped with the organic EL voltage-current characteristic, that is, the characteristic of the organic EL current 61 with respect to the organic EL voltage which is the difference between the organic EL drive voltage 57 and the drive transistor source-drain voltage 60. The intersection point of the two characteristic curves indicates the value of the organic EL current 61 (denoted by Ia) when the organic EL drive voltage 57 and the signal voltage 58 are set to certain values.

Reference numeral 70 denotes a drive transistor voltage-current characteristic at a low organic EL drive voltage; 71, an organic EL voltage-current characteristic at the low organic EL drive voltage; and 72, an organic EL operating point at the low organic EL drive voltage. As the organic EL drive voltage 57 decreases, so does the source-gate voltage 59. Therefore, the drive transistor voltage-current characteristic changes from the drive transistor voltage-current characteristic 62 to the drive transistor voltage-current characteristic 70 at the low organic EL drive voltage. Likewise, as the organic EL drive voltage 57 decreases, so does the organic EL voltage since the organic EL voltage is the difference between the organic EL drive voltage 57 and the source-drain voltage. Therefore, the organic EL voltage-current characteristic changes from the organic EL voltage-current characteristic 62 to the organic EL voltage-current characteristic 71 at the low organic EL drive voltage. The intersection point of the two characteristic curves is the organic EL operating point 72. The figure indicates that the organic EL current 61 decreases from Ia to Ib. Thus, a reduction in the organic EL drive voltage leads to a reduction in the organic EL current, that is, a reduction in the luminance.

Figure 5A:
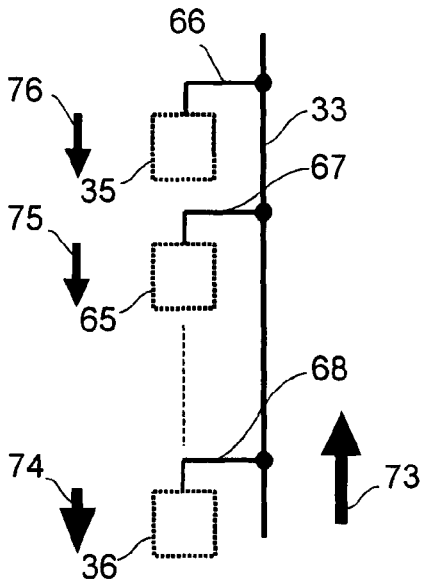
FIG. 5 (including FIGS. 5A to 5D) is another conceptual diagram illustrating the current control according to the first embodiment of the present invention.
Figure 5B:
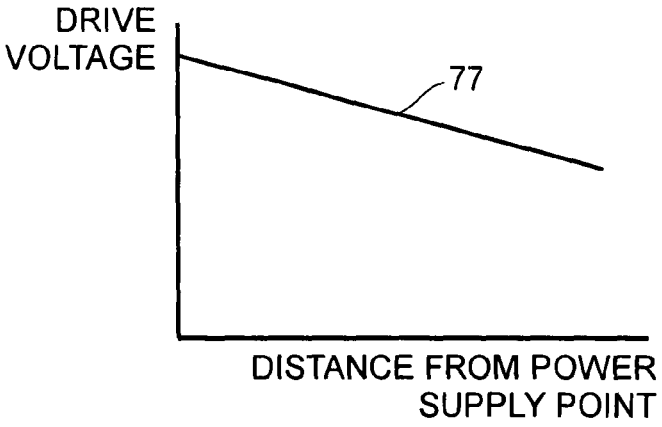
Figure 5C:
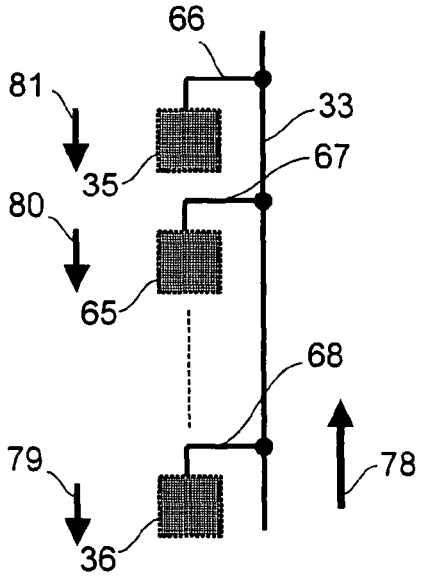
Figure 5D:
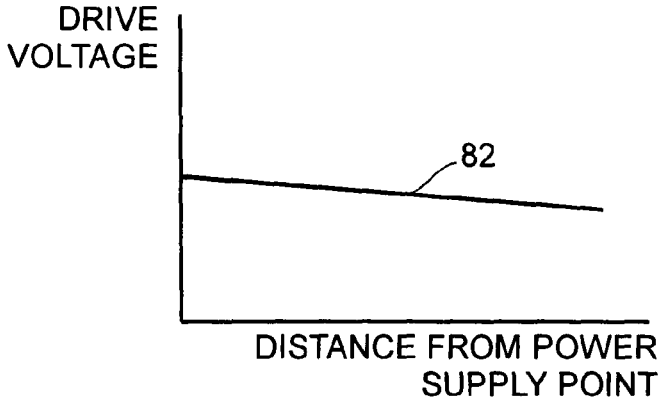

FIG. 5A is a diagram showing the configuration of organic EL drive voltage supply lines and pixels in a white display according to the first embodiment of the present invention. FIG. 5B shows the relationship between the pixel position (the distance from the power supply point to each pixel) and the drive voltage in the white display according to the first embodiment of the present invention. FIG. 5C is a diagram showing the configuration of the organic EL drive voltage supply lines and pixels in a gray display (between black and white) according to the first embodiment of the present invention. FIG. 5D shows the relationship between the pixel position and the drive voltage in the gray display (between black and white) according to the first embodiment of the present invention. The distance from the power supply point to each pixel refers to, for example, the sum of the lengths of the organic EL drive voltage supply line 32 and the first-column organic EL drive voltage supply line 33 from the drive voltage generating circuit 18 to the first-row first-column pixel. Reference numeral 65 denotes a second-row first-column pixel; 66, a first-row organic EL drive voltage; 67, a second-row drive voltage; and 68, a $480^{th}$-row drive voltage. The organic EL drive voltage is supplied from the $480^{th}$-row first-column pixel 36 side to the upper pixels in the first column through the first-column organic EL drive voltage supply line 33 such that the first-row organic EL drive voltage 66 is applied to the first-row first-column pixel 35, the second-row organic EL drive voltage 67 is applied to the second-row first-column pixel 65, and the $480^{th}$-row organic EL drive voltage 68 is applied to the $480^{th}$-row first-column pixel 36. Reference numeral 77 denotes a pixel position vs. drive voltage characteristic. The horizontal axis indicates the pixel position expressed as the distance from the power supply point (from which the drive voltage is supplied) to each pixel, while the vertical axis indicates the value of the organic EL drive voltage applied to each pixel. The figure indicates that the organic EL drive voltage supply line 33 has wiring resistance, and therefore the larger the distance of a pixel from the power supply point, the larger the resistance of the wiring to the pixel and the smaller its organic EL drive voltage. That is, since the pixels aligned in the vertical direction are all connected to the single organic EL drive voltage supply line 33, a voltage drop occurs between the lowermost pixel and the uppermost pixel due to the wiring resistance. As a result, the drive voltage applied to each pixel is as indicated by the pixel position vs. drive voltage characteristic 77.

Reference numeral 73 denotes a power supply inlet current (an input current) in a white display; 74, the current of the $480^{th}$-row pixel in the white display; 75, the current of the second-row pixel in the white display; 76, the current of the first-row pixel in the white display; and 77, a pixel position vs. drive voltage characteristic in the white display. The power supply inlet current in the white display 73 is the largest since an organic EL current flows through each pixel in the white display. Since the first-column organic EL drive voltage supply line 33 has wiring resistance, the larger the current, the larger the voltage drop. Therefore, the pixel position vs. drive voltage characteristic in the white display 77 has a significant slope as shown in FIG. 5B. The current 76 of the first-row pixel, which is far way from the power supply point, is smaller than the current 74 of the $480^{th}$-row pixel, which is close to the power supply point, that is, the display luminance of the first-row pixel is lower. Reference numeral 78 denotes a power supply inlet current (an input current) in a gray display; 79, the current of the $480^{th}$-row pixel in the gray display; 80, the current of the second-row pixel in the gray display; 81, the current of the first-row pixel in the gray display; and 82, a pixel position vs. drive voltage characteristic in the gray display. The power supply inlet current in the gray display 78 is smaller than the power supply inlet current in the white display 73 since the current flowing through each pixel is smaller in the gray display. Since the first-column organic EL drive voltage supply line 33 has wiring resistance, the smaller the current, the smaller the voltage drop. Therefore, the pixel position vs. drive voltage characteristic in the gray display 82 has a moderate slope as shown in FIG. 5D. There is not a large difference between the gray scale current 78 of the $480^{th}$-row pixel, which is close to the power supply point, and the gray scale current 81 of the first-row pixel, which far away from the power supply point. That is, their display luminance levels are not much different from each other. A comparison of FIGS. 5B and 5D indicates that the white display exhibits a voltage drop and a voltage drop rate larger than those of the black display since the display brightness is higher in the white display than in the black display.

Figure 6A:
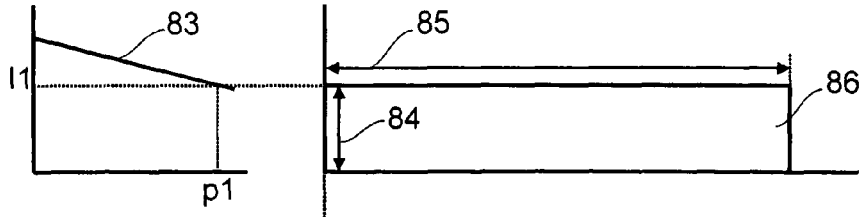
FIG. 6 (including FIGS. 6A to 6F) is still another conceptual diagram illustrating the current control according to the first embodiment of the present invention.
Figure 6B:
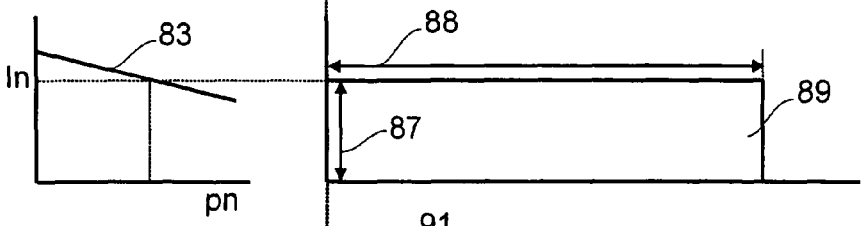
Figure 6C:
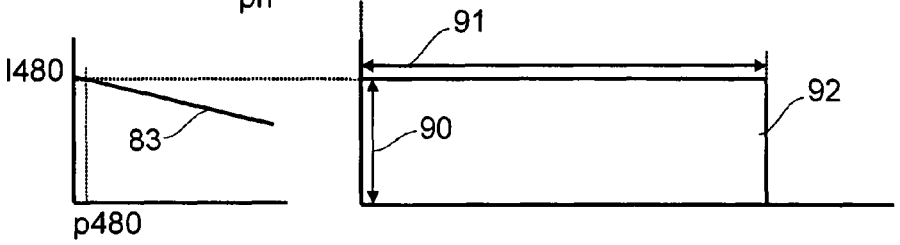
Figure 6D:
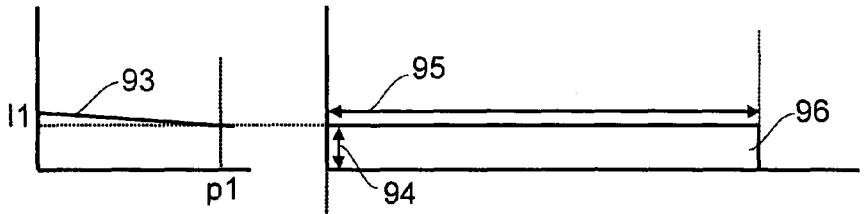
Figure 6E:
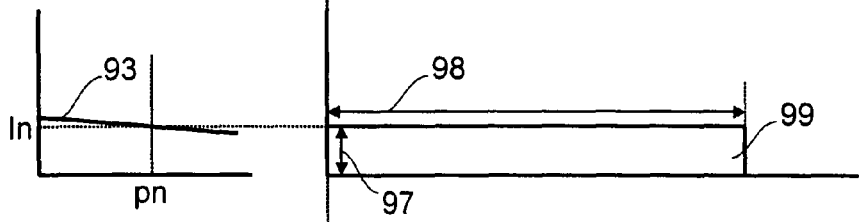
Figure 6F:
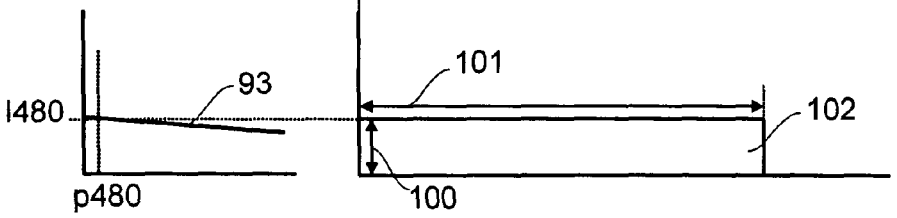

FIG. 6 includes FIG. 6A to 6F showing the concept of a technique for providing substantially uniform display luminance by setting the light emission time period of each pixel based on its position according to the first embodiment of the present invention. FIGS. 6A to 6C show a large voltage drop such as that produced in a white display. FIGS. 6D to 6F, on the other hand, show a small voltage drop such as that produced in a gray scale display or a black display. FIG. 6A shows a pixel at the top of the screen far from the organic EL drive voltage supply point; FIG. 6B shows a pixel near the center of the screen closer to the organic EL drive voltage supply point than the pixel in FIG. 6A; and FIG. 6C shows a pixel at the bottom of the screen closest to the organic EL drive voltage supply point. Reference numeral 83 denotes a pixel position vs. organic EL current characteristic in a white display, which is similar to the pixel position vs. drive voltage characteristic shown in FIG. 5B since the current is proportional to the voltage. Reference numeral 84 denotes the current of the top organic EL (EL element) in a white display; 85, the light emission time period of the top (organic EL) in the white display; 86, the effective luminance of the top in the white display; 87, the current of the center organic EL in the white display; 88, the light emission time period of the center (organic EL) in the white display; 89, the effective luminance of the center in the white display; 90, the current of the bottom organic EL in the white display; 91, the light emission time period of the bottom (organic EL) in the white display; and 92, the effective luminance of the bottom in the white display. Since the current 84 of the top organic EL in the white display is small, the light emission time period 85 of the top in the white display is increased, as shown in FIG. 6A. On the other hand, since the current 90 of the bottom organic EL in the white display is large, the light emission time period 91 of the bottom in the white display is reduced, as shown in FIG. 6C. This makes the effective luminance 86 of the top in the white display and the effective luminance 92 of the bottom in the white display equal to each other. The effective luminance 86 of the top in the white display is represented by the area defined by the current 84 of the top organic EL in the white display and the light emission time period 85 of the top in the white display in the figure, while the effective luminance 92 of the bottom in the white display is represented by the area defined by the current 90 of the bottom organic EL in the white display and the light emission time period 91 of the bottom in the white display in the figure. It should be noted that as the display becomes less dark from black to white (that is, the gray scale value of the display data becomes larger, or the display brightness becomes higher), the voltage drop rate represented by the slope and the value of the voltage drop increase, making it desirable to increase the increment of the light emission time period of each pixel. It should be further noted that the display brightness can be estimated from the amount of current in the organic EL drive voltage supply line.

FIG. 6D shows a pixel at the top of the screen far from the organic EL drive voltage supply point; FIG. 6E shows a pixel near the center of the screen closer to the organic EL drive voltage supply point than the pixel in FIG. 6D; and FIG. 6F shows a pixel at the bottom of the screen closest to the organic EL drive voltage supply point. Reference numeral 93 denotes pixel position vs. organic EL current characteristic in a gray display, which is similar to the pixel position vs. drive voltage characteristic shown in FIG. 5D since the current is proportional to the voltage. Reference numeral 94 denotes the current of the top organic EL in a gray display; 95, the light emission time period of the top (organic EL) in the gray display; 96, the effective luminance of the top in the gray display; 97, the current of the center organic EL in the gray display; 98, the light emission time period of the center (organic EL) in the gray display; 99, the effective luminance of the center in the gray display; 100, the current of the bottom organic EL in the gray display; 101, the light emission time period of the bottom (organic EL) in the gray display; and 102, the effective luminance of the bottom in the gray display. Since there is only a small difference between the current 94 of the top organic EL in the gray display and the current 100 of the bottom organic EL in the gray display, the difference between the light emission time period 95 of the top in the gray display and the light emission time period 101 of the bottom in the gray display is set to a corresponding small value. This makes the effective luminance 96 of the top in the gray display and the effective luminance 102 of the bottom in the gray display equal to each other. The effective luminance 96 of the top in the gray display is represented by the area defined by the current 94 of the top organic EL in the gray display and the light emission time period 95 of the top in the gray display in the figure, while the effective luminance 102 of the bottom in the gray display is represented by the area defined by the current 100 of the bottom organic EL in the gray display and the light emission time period 101 of the bottom in the gray display in the figure.

The display control unit 6 comprises a storage control unit and a display control signal generating unit. To output display data at the display timing of the display unit 25, the storage control unit generates the read/write command 9 and the read/write address 10 to read out the screen data 13 from the screen storage circuit 12. The storage control unit also generates the read/write command 9, the read/write address 10, and the data to be written 11 to store the display data 4. The display control signal generating unit generates a data read-out instruction signal at a timing matching the display timing of the display unit 25 and puts together the generated signal and the read display data into the dataline drive signals 7 which are output as data and timing signals for operating the dataline drive circuit 14. The display control signal generating unit also generates the scanline drive signals 8 which include timing signals for operating the scanline drive circuit 16. The display control signal generating unit 104 comprises a basic clock generating circuit, a horizontal counter, a vertical counter, a stored data read-out timing control circuit, a data timing adjusting circuit, a dataline drive control circuit, a scanline drive control circuit, a scanning start signal, and a scanning shift clock control circuit. The basic clock generating circuit generates a basic clock, based on which control signals are generated subsequently to operate the display unit 25. The horizontal counter steadily counts up during each horizontal period according to the basic clock and outputs its counter value as the horizontal count value each time it counts. When each horizontal period has been completed, the horizontal counter resets the horizontal count value and outputs a vertical count timing (signal). The vertical counter steadily counts up during each frame period according to the vertical count timing and outputs its counter value as the vertical count value each time it counts. When each frame period has been completed, the vertical counter resets the vertical count value. The timing control circuit generates the data read-out instruction signal to read out the display data stored in the storage circuit 12 according to the horizontal count value and the vertical count value. The dataline drive control circuit generates a dataline drive timing signal according to the horizontal count value and the vertical count value. The dataline drive circuit 14 uses this dataline drive timing signal to latch and output dataline drive data. The data timing adjusting circuit adjusts the timing of the display data according to the horizontal count value and the vertical count value such that it matches the timing of the dataline drive timing signal, and outputs the display data as dataline drive data. The dataline drive signals 7 include the basic clock, the dataline drive data, and the dataline drive timing signal. The scanline drive control circuit generates a scanning start signal indicating the beginning of a frame based on the horizontal count value. The scanning shift clock control circuit generates a scanning shift clock according to the vertical count timing. The scanline drive circuit 16 uses the generated scanning shift clock to shift the scanning start signal to produce a signal for each horizontal scanline. The scanline control signals 8 include the scanning start signal and the scanning shift clock.

Figure 7:
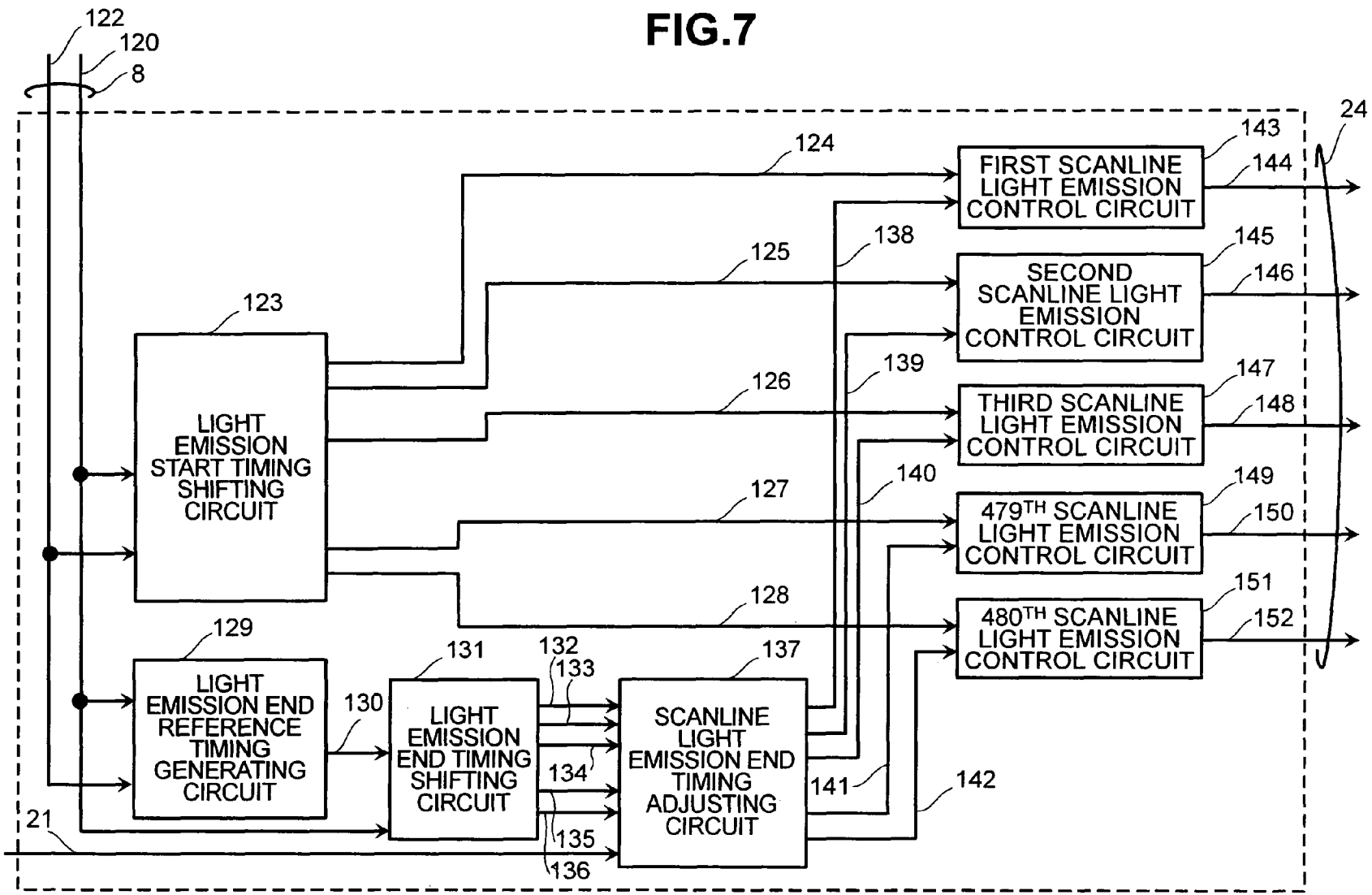
FIG. 7 is a diagram showing the internal configuration of a pixel light emission control circuit 23 according to the first embodiment of the present invention.

FIG. 7 is a diagram showing the internal configuration of the pixel light emission control circuit 23 according to the first embodiment of the present invention. Reference numeral 123 denotes a light emission start timing shifting circuit; 124, a first scanline light emission start timing signal; 125, a second scanline light emission start timing signal; 126, a third scanline light emission start timing signal; 127, a $479^{th}$ scanline light emission start timing signal; and 128, a $480^{th}$ scanline light emission start timing signal. The light emission start timing shift circuit 123 shifts the scanning start signal 120 according to the scanning shift clock to produce 480 scanline light emission start timing signals, from the first scanline light emission start timing signal 124 to the $480^{th}$ scanline light emission start timing signal 128, each indicating the light emission start timing of a scanline. It should be noted that the first embodiment assumes that the light emission start timings coincide with the scanning start timings. However, the light emission start timings may be delayed from the scanning start timings. Reference numeral 129 denotes a light emission end reference timing generating circuit; and 130 denotes a light emission end reference timing signal. The light emission end reference timing generating circuit 129 generates the light emission end reference timing signal 130 from the scanning start signal 120 to produce a light emission end reference timing. The following description assumes that the scanning start signal 120 is latched for a time period corresponding to a given number of cycles of the scanning shift clock signal 122 to produce the light emission end reference timing signal 130. Reference numeral 131 denotes a light emission end timing shifting circuit; 132, a first scanline light emission end reference timing signal; 133, a second scanline light emission end reference timing signal; 134, a third scanline light emission end reference timing signal; 135, a $479^{th}$ scanline light emission end reference timing signal; and 136, a $480^{th}$ scanline light emission end reference timing signal. The light emission end timing shifting circuit 131 shifts the light emission end reference timing signal 130 according to the scanning shift clock 122 to produce 480 scanline light emission end reference timing signals, from the first scanline light emission end reference timing signal 132 to the $480^{th}$ scanline light emission end reference timing signal 136, each indicating a light emission end reference timing for a scanline. Reference numeral 137 denotes a scanline light emission end timing adjusting circuit; 138, a first scanline light emission end timing signal; 139, a second scanline light emission end timing signal; 140, a third scanline light emission end timing signal; 141, a $479^{th}$ scanline light emission end timing signal; and 142, a $480^{th}$ scanline light emission end timing signal. The scanline light emission end timing adjusting circuit 137 performs timing adjustment of the first to $480^{th}$ scanline light emission end reference timing signals (132 to 136) separately, applying an arbitrary amount of adjustment to each signal, to produce the first to $480^{th}$ scanline light emission end timing signals (138 to 142). The amount of adjustment can be set for each scanline independently and changed according to the current detection information 21. Reference numeral 143 denotes a first scanline light emission control circuit; 144, a first scanline light emission control signal; 145, a second scanline light emission control circuit; 146, a second scanline light emission control signal; 147, a third scanline light emission control circuit; 148, a third scanline light emission control signal; 149, a $479^{th}$ scanline light emission control circuit; 150, a $479^{th}$ scanline light emission control circuit; and 151, a $480^{th}$ scanline light emission control circuit; and 152, a $480^{th}$ scanline light emission control signal. Each scanline light emission control circuit receives a light emission start timing signal and a light emission end timing signal and generates a scanline light emission control signal indicating the light emission time period of a scanline. The following description assumes that each light emission control signal is at the High level during the time period from the light emission start timing to the light emission end timing. Therefore, the pixel light emission control circuit 23 controls the time period during which the light emission control switch 43 is ON. However, it may be arranged that the pixel light emission control circuit 23 controls the time period during which the light emission control switch 43 is OFF. In such a case, the light emission control signal is at the High level during the time period from the light emission end timing to the light emission start timing.

Figure 8:
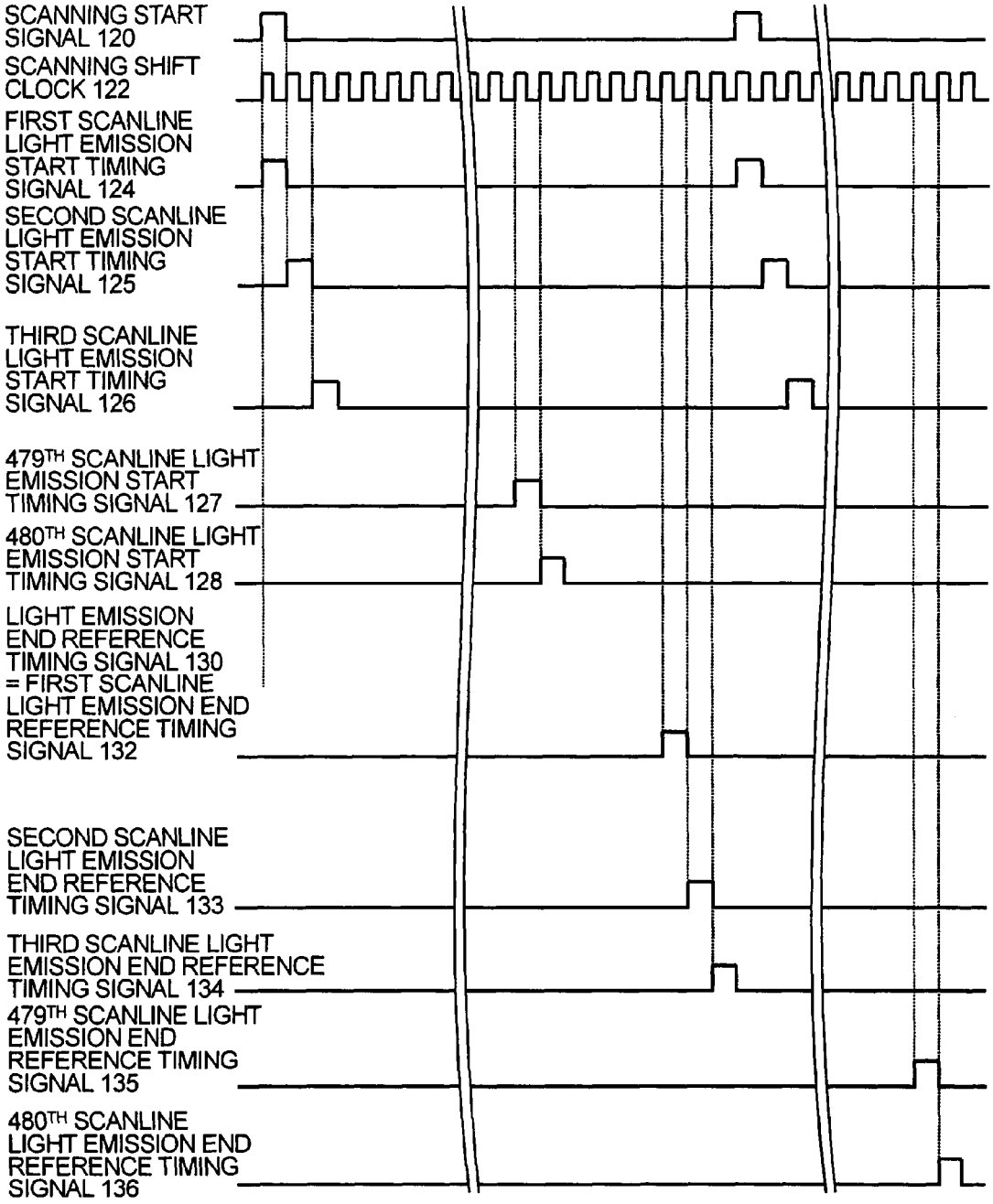
FIG. 8 is a diagram showing operational timings of a light emission start timing shifting circuit 123, a light emission end reference timing generating circuit 129, and a light emission end timing shifting circuit 131 according to the first embodiment of the present invention.

FIG. 8 is a diagram showing operational timings of the light emission start timing shifting circuit 123, the light emission end reference timing generating circuit 129, and the light emission end timing shifting circuit 131 according to the first embodiment of the present invention. Each scanline light emission start timing signal is obtained as a result of shifting the scanning start signal 120 according to the scanning shift clock 122 by one cycle of the clock at a time. The light emission end reference timing signal 130, on the other hand, is obtained as a result of shifting the scanning start signal 120 by a time period corresponding to a given number of cycles of the scanning shift clock 122. The light emission end reference timing signal 130 is shifted according to the scanning shift clock 122 by one cycle of the clock at a time to produce the first to $480^{th}$ scanline light emission end reference timing signals (132 to 136).

Figure 9:
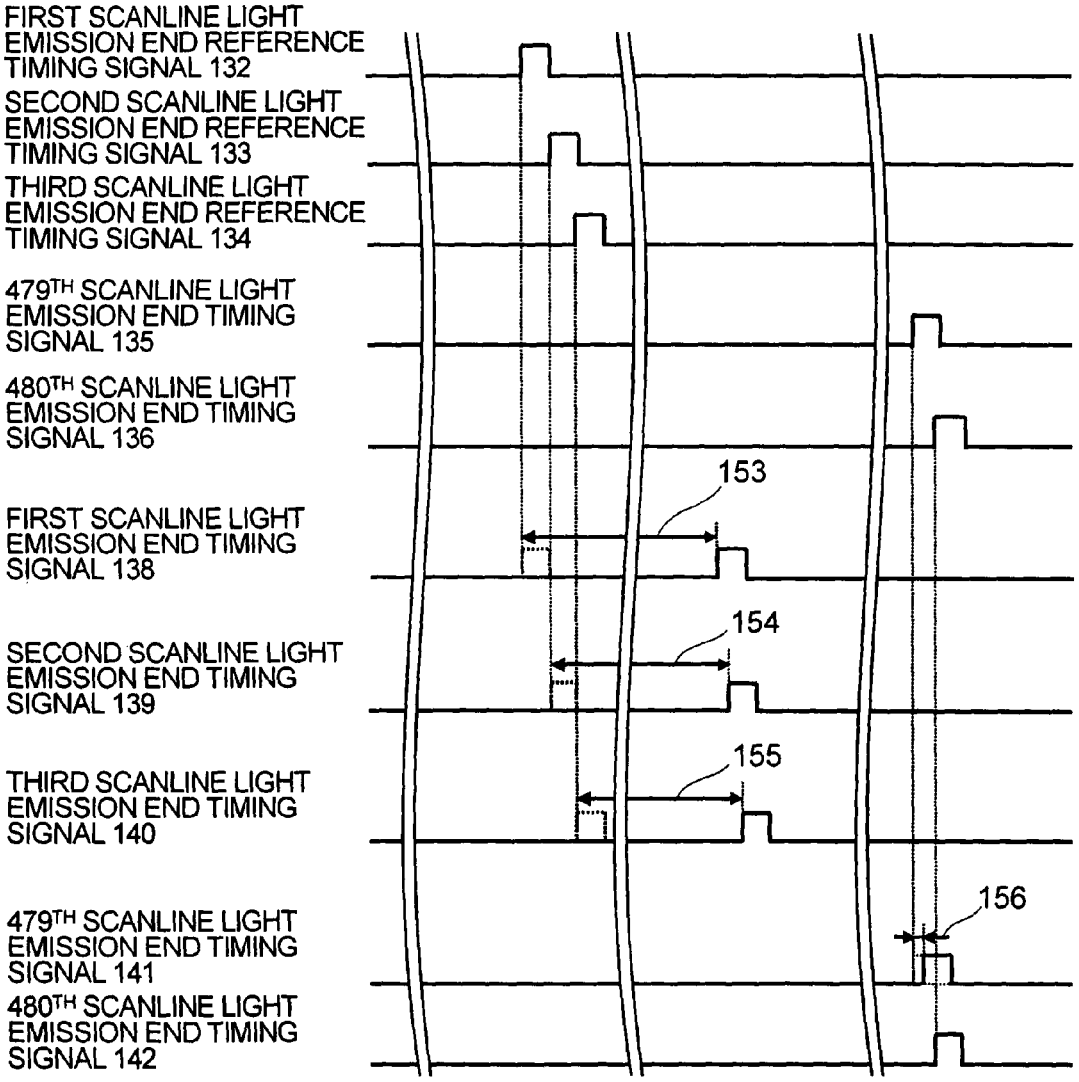
FIG. 9 is a diagram showing operational timings of a scanline light emission end timing adjusting circuit 137 according to the first embodiment of the present invention.

FIG. 9 is a diagram showing operational timings of the scanline light emission end timing adjusting circuit 137 according to the first embodiment of the present invention. Reference numeral 153 denotes a first scanline light emission end timing adjustment amount; 154, a second scanline light emission end timing adjustment amount; 155, a third scanline light emission end timing adjustment amount; and 156, a $479^{th}$ scanline light emission end timing adjustment amount. The first to $480^{th}$ scanline light emission end timing signals (138 to 142) are obtained as a result of delaying the first to $480^{th}$ scanline light emission end reference timing signals (132 to 136) by the different timing adjustment amounts 153 to 156, respectively.

Figure 10:
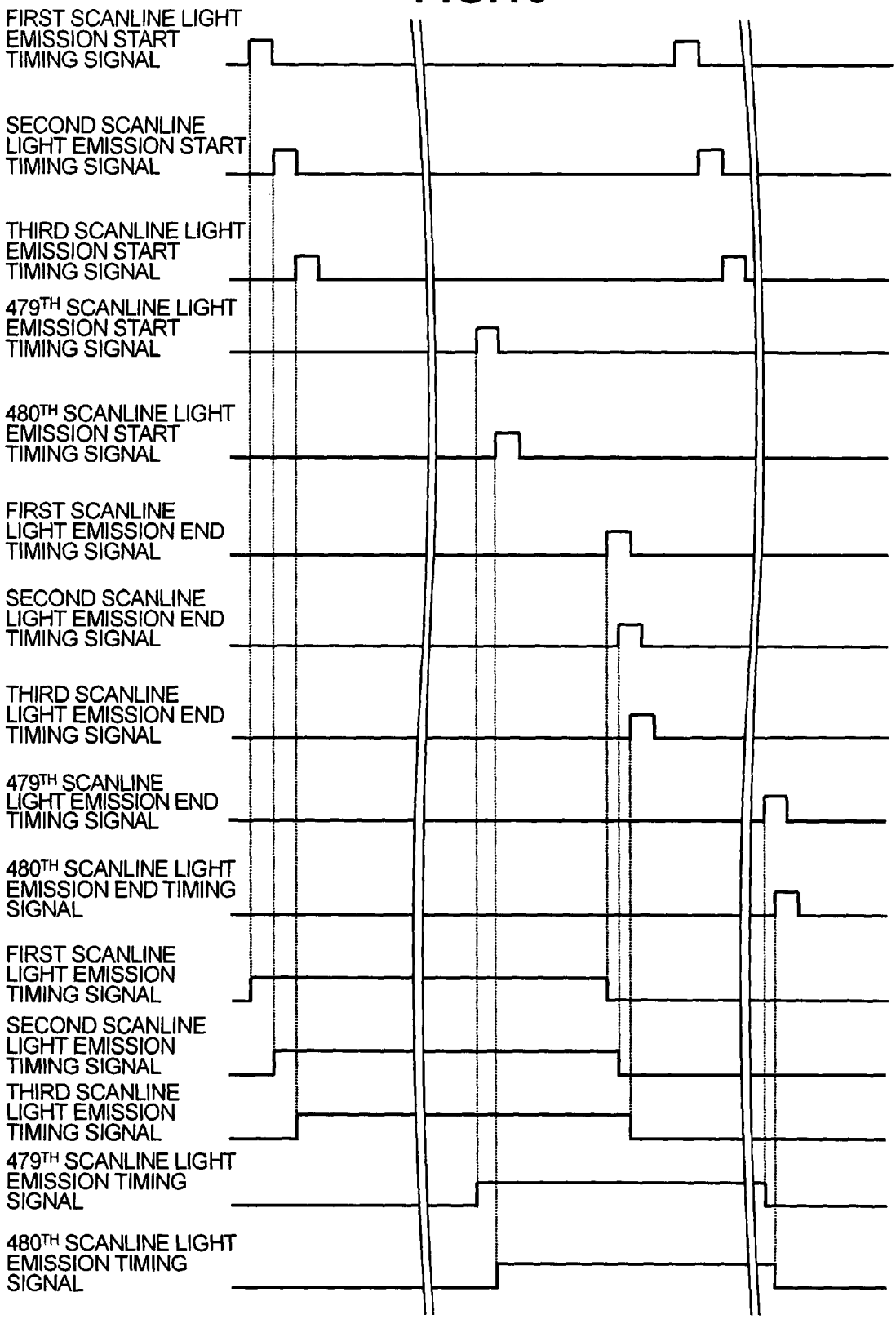
FIG. 10 is a diagram showing operational timings of a first scanline light emission control circuit 143, a second scanline light emission control circuit 145, a third scanline light emission control circuit 147, a $479^{th}$ scanline light emission control circuit 149, and a $480^{th}$ scanline light emission control circuit 151 according to the first embodiment of the present invention.

FIG. 10 is a diagram showing operational timings of the first scanline light emission control circuit 143, the second scanline light emission control circuit 145, the third scanline light emission control circuit 147, the $479^{th}$ scanline light emission control circuit 149, and the $480^{th}$ scanline light emission control circuit 151 according to the first embodiment of the present invention. Each scanline light emission control signal is at the High level during the time period from the rising edge of the corresponding light emission start timing signal to the rising edge of the corresponding light emission end timing signal.

Formulas 1 to 3 below are used to calculate the first scanline light emission end timing adjustment amount 153, the second scanline light emission end timing adjustment amount 154, the third scanline light emission end timing adjustment amount 155, and the $479^{th}$ scanline light emission end timing adjustment amount 156 shown in FIG. 9.

$$V_{EL}=R\times I_{EL} \quad \text{Formula 1}$$

where $V_{EL}$ denotes the organic EL drive voltage drop between the top and the bottom, R denotes the wiring resistance between the top and the bottom, and $I_{EL}$ denotes the organic EL drive current.

$$C_{EL}=\frac{V_{EL}}{V_D} \quad \text{Formula 2}$$

where $V_D$ denotes the organic EL drive voltage and $C_{EL}$ denotes the organic EL drive voltage drop rate.

$$T_Wn=\frac{C_{EL}}{(N-1)}\times(N-n)\times Tf \quad \text{Formula 3}$$

$$Tf > Tb + T_Wn\,(\text{max.})$$

where $T_{Wn}$ denotes the light emission end timing adjustment amount for the n-th scanline, N denotes the total number of scanlines, Tf denotes the scanline drive cycle period, and Tb denotes the light emission end reference timing delay amount.

When the organic EL drive voltage $V_{EL}$ and the wiring resistance R are set beforehand, the light emission end timing adjustment amount for each scanline $T_{Wn}$ is determined from the above formulas 1 to 3 by obtaining the value of the organic EL drive current $I_{EL}$ from the current detection information 21.

Thus, the first embodiment of the present invention detects the amount of current flowing through the organic EL drive voltage line and uses this information to perform the pixel light emission control, making it possible to reduce the luminance change due to the voltage drop occurring across the wiring resistance.

The pixel light emission control of the first embodiment will be described with reference to FIGS. 1 to 10 and Formulas 1 to 3.

First of all, description will be made of the display data flow with reference to FIG. 1. In the figure, the display control unit 6 temporarily stores one screen of display data 4 in the screen storage circuit 12 as the data 11. The display control unit 6 then reads out the display data as the screen data 13 from the screen storage circuit 12 at the display timing of the display unit 25 and generates the dataline drive signals 7 and the scanline control signals 8 (the details of this operation will be described later). It should be noted that since the screen storage circuit 12 is usually employed when the input display data 4 has a display resolution or a timing different from that of the display unit 25, this circuit may be omitted when they have the same timing and resolution. The dataline drive circuit 14 latches one or a plurality of lines of dataline drive signals 7 which include 4-bit gray scale information, converts the signals into signal voltages for causing the pixels on the display unit 25 to emit light, and outputs the converted signal voltages as the dataline drive signals 15 (the details of this operation will be described later). The scanline drive circuit 16 outputs the scanline drive signals 17 so as to sequentially select the scanlines on the display unit 25 (the details of this operation will be described later). The drive voltage generating circuit 18 generates the drive reference voltage 19 used as a reference for generating a drive voltage for causing the organic ELs to emit light. The current detecting circuit 20 generates the organic EL drive voltage 22, detects the current flowing through the organic EL drive voltage 22 supply line, and outputs the digital current detection information 21 indicating the amount of the current. It should be noted that according to the first embodiment, the current detecting circuit 20 is provided between the drive voltage generating circuit 18 and the display unit 25. However, the current detecting circuit 20 may be provided for each column-wise organic EL voltage drive line in the display unit 25 (for example, the first-column organic EL voltage drive line 33, the second-column organic EL voltage drive line 34, etc.). Further, the current detecting circuit 20 may be provided on the opposite electrode side (the side on which the current leaves each pixel). That is, it may be disposed at the outlet of the display unit 25, or it may be provided for each column-wise organic EL voltage drive line (on that side) in the display unit 25 (for example, the first-column organic EL voltage drive line 33, the second-column organic EL voltage drive line 34, etc.). Thus, the current detecting circuit 20 can be disposed at any position on the organic EL drive voltage supply lines. Still further, if the organic EL voltage drive lines are provided row-wise, the current detecting circuit 20 may be provided for each row-wise organic EL voltage drive line in the display unit 25 (for example, the first-row organic EL voltage drive line, the second-row organic EL voltage drive line, etc.). The pixel light emission control circuit 23 generates the pixel light emission control signals 24 to control the switch in each pixel of the display unit 25 on a scanline basis (the details of this operation will be described later). On the display unit 25, the pixels on the scanline selected by each scanline drive signal 17 are caused to emit light according to the voltages of the dataline drive signals 15 and the pixel light emission control signals 24 (the details of this operation will be described later).

Description will be made of the light emission operation of the display unit 25 shown in FIG. 1 with reference to FIGS. 2 and 3. In FIG. 2, when a scanline selection voltage is supplied through the first scanline 28, the switching transistor 40 is turned on and the data signal voltage is stored on the write capacitance 41 through the first dataline 26. As a result, the drive transistor 42 operates to control the current flowing through the organic EL 44. The current determined according to the voltage-current characteristic of the drive transistor 42 flows in the organic EL 44 through the light emission switch 43, causing the organic EL 44 to emit light. The light emission switch 43 is turned on or off by the light emission control signal supplied through the first light emission control line 30. Even through the light emission control switch 43 is indicated by a schematic symbol of a mechanical switch in the figure, it is generally implemented by a MOS transistor(s). However, any circuit that has a switching function can be used as the light emission control switch 43.

Description will be made of the light emission control operation for each scanline with reference to FIG. 3. In the figure, each scanline is sequentially selected (starting with the first scanline) by setting its scanline signal at the High level, writing the signal voltage. After the signal voltage has been written, each pixel emits light while its light emission control signal is at the High level.

Figure 12:
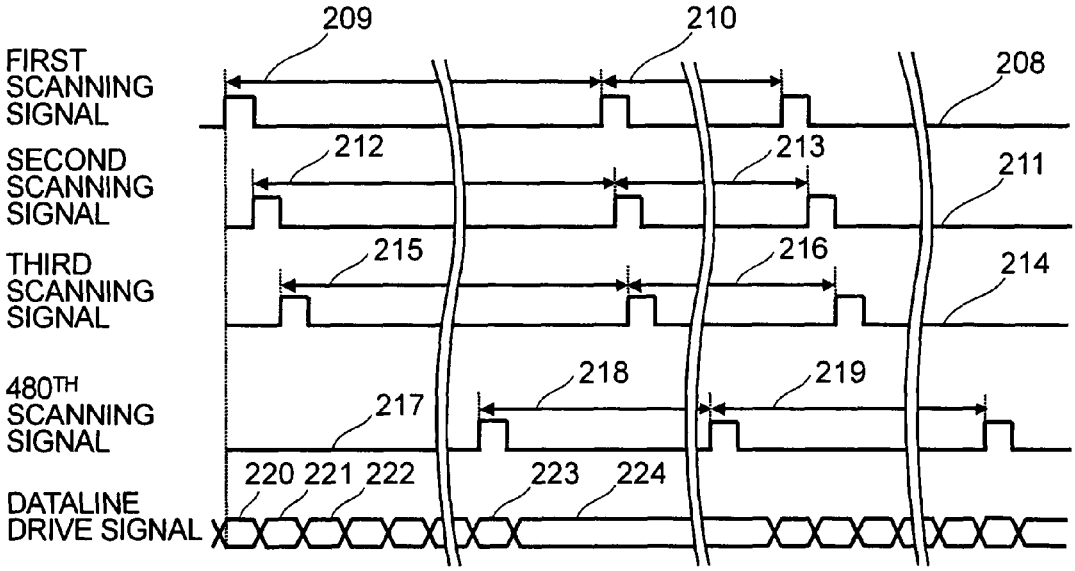
FIG. 12 is a diagram showing a scanline multiple drive signal 204 and a dataline drive signal 15 for each scanline according to the second embodiment of the present invention.

Description will be made below of the operation of the pixel light emission control circuit 23 in detail with reference to FIGS. 7 to 10. In FIG. 7, the light emission start timing shifting circuit 123 shifts the scanning start signal 120 according to the scanning shift clock 122 by one cycle of the clock at a time (as shown in FIG. 12) to produce 480 scanline light emission start timing signals (from the first scanline light emission start timing signal 124 to the $480^{th}$ scanline light emission start timing signal 128). In FIG. 8, the first scanline light emission start timing signal 124 is set to have the same timing as that of the scanning start timing signal 120. However, they need not necessarily have the same timing. It is only necessary that the phase relationships between the 480 scanline light emission start timing signals are set such that they are sequentially shifted by one cycle of the scanning shift clock 122 with respect to one another, as shown in FIG. 8. Therefore, the present embodiment is not limited to the above particular configuration of the light emission start timing shifting circuit 123 if these phase relationships can be maintained. The light emission end reference timing generating circuit 129 generates the light emission end reference timing signal 130, which is obtained as a result of extending the High level period of the scanning start signal 120 by a certain amount, as shown in FIG. 8 (how to determine this amount will be described later). The light emission end timing shifting circuit 131 shifts the light emission end reference timing signal 130 according to the scanning shift clock 122 by one cycle of the clock at a time to produce 480 scanline light emission end reference timing signals (from the first scanline light emission end reference timing signal 132 to the $480^{th}$ scanline light emission end reference timing signal 136), as shown in FIG. 8. In FIG. 8, the first scanline light emission end reference timing signal 132 is set to have the same timing as that of the light emission end reference timing signal 130. However, they need not necessarily have the same timing. It is only necessary that the phase relationships between the 480 scanline light emission end reference timing signals are set such that the signals are sequentially shifted by one cycle of the scanning shift clock 122 with respect to one another, as shown in FIG. 8. Therefore, the present embodiment is not limited to the above particular configuration of the light emission end timing shifting circuit 131 if these phase relationships can be maintained. The scanline light emission end timing adjusting circuit 137 delays each of the first to $480^{th}$ scanline light emission end reference timing signals (132 to 136) by a different timing adjustment amount to produce the first to $480^{th}$ scanline light emission end timing signals (138 to 142), as shown in FIG. 9. Each timing adjustment amount is determined according to the current detection information 21 (the details of this determination will be described later). Lastly, as shown in FIG. 10, the first scanline light emission control circuit 143, the second scanline light emission control circuit 145, the third scanline light emission control circuit 147, the $479^{th}$ scanline light emission control circuit 149, and the $480^{th}$ scanline light emission control circuit 151 generates the first scanline light emission control signal 144, the second scanline light emission control signal 146, the third scanline light emission control signal 148, the $479^{th}$ scanline light emission control signal 150, and the $480^{th}$ scanline light emission control signal 152, which are at the High level during the time period from the rising edge of their corresponding scanline light emission start timing signals (124 to 128) to the rising edge of their corresponding scanline light emission end timing signals (138 to 142). The above configuration for generating each scanline light emission control signal is by way of example only. Any circuit configuration can be employed if it provides a light emission control signal for each scanline having a different High level period, as shown in FIG. 10. Further, even though the display apparatus discussed above has 480 circuits to handle the 480 scanlines separately (480 vertical dots), a different number of separate circuits may be employed according to the resolution of the display, making it possible to support all display resolutions.

Lastly, description will be made of an example of how to determine the timing adjustment amount. Referring to Formulas 1 to 3, the values of the wiring resistance R, the organic EL drive voltage $V_D$, and the scanline drive cycle period Tf are determined beforehand in the design phase. Then, the value of the organic EL current $I_{EL}$ from the current detection information 21 is obtained to derive the n-th scanline light emission end timing adjustment amount $T_{wn}$. Referring to FIG. 8, the light emission end reference timing signal 130 must be set such that the scanline drive cycle period Tf is not exceeded even when $T_{Wn}$ is maximized (n=1). The position n of a scanline coincides with or is proportional to the distance between the power supply point and its pixels. Therefore, the light emission end timing adjustment amount is proportional to the organic EL current $I_{EL}$ and the distance between the power supply point and the pixels. Since the light emission start timing is proportional to the scanline drive cycle period Tf, the light emission time period of the organic ELs is proportional to the organic EL current $I_{EL}$ and the distance between the power supply point and the pixels. It should be noted that it is only necessary to control the light emission time period of each organic EL in some way. Therefore, a pixel may be caused to emit light a plurality of times during each frame period. In such a case, there are a plurality of light emission start timings and a plurality of light emission end timings for each pixel during each frame period.

It should be noted that the display luminance of the pixels may be measured, instead of detecting the amount of current flowing through the drive voltage supply line, and the timing adjustment amount may be set according to the measured display luminance. A luminance measuring circuit for measuring display luminance is provided to measure the display luminance of each pixel on the screen.

Alternatively, a luminance measuring circuit may calculate the display luminance of each pixel or each column of pixels or each row of pixels from the gray scale data of the display data.

Further, in the display apparatus described above, the organic EL drive voltage is supplied from the bottom of the screen. If, however, the drive voltage supply point is located on a different side, or there are a plurality of drive voltage supply points, a timing adjustment amount setting method corresponding to each case may be used. That is, the light emission time period of the organic EL 44 of each pixel is increased with increasing distance between the pixel and the drive voltage supply point (as the pixel becomes farther from the drive voltage supply point). According to the first embodiment, the light emission time period of each pixel is set as follows. If the drive voltage supply point is located at the bottom of the display unit 25, the light emission time period of each organic EL 44 is increased as its position becomes closer to the top of the display unit 25 (farther from the bottom). If the drive voltage supply point is located at the top of the display unit 25, the light emission time period of each organic EL 44 is increased as its position becomes closer to the bottom of the display unit 25 (farther from the top). If the drive voltage supply point is located at the right side of the display unit 25, the light emission time period of each organic EL 44 is increased as its position becomes closer to the left side of the display unit 25 (farther from the right side). If the drive voltage supply point is located at the left side of the display unit 25, the light emission time period of each organic EL 44 is increased as its position becomes closer to the right side of the display unit 25 (farther from the left side). However, since the voltage drop between the organic ELs 44 of neighboring pixels is small, the light emission time period of each pixel may be controlled such that a plurality of (for example, 2 or 3) neighboring pixels may be set to have the same light emission time period. For example, when the drive voltage is supplied for each column of pixels, the light emission time periods of pixels in neighboring rows may be controlled at the same time (the same light emission time period may be set for these neighboring pixels). When the drive voltage is supplied for each row of pixels, on the other hand, the light emission time periods of pixels in neighboring columns may be controlled at the same time (the same light emission time period may be set for these neighboring pixels). This arrangement simplifies the light emission time period control of the organic ELs 44. The first embodiment of the present invention described above makes it possible to control the light emission time period of each pixel according to the voltage drop (between the drive voltage supply point and the pixel) determined by the position of the pixel and the amount of current flowing through the drive voltage supply line, producing the effect of reducing the degree of unevenness of the brightness on the screen occurring even when the display data for each pixel indicates the same luminance value.

A second embodiment of the present invention will be described below with reference to accompanying drawings.

Figure 11:
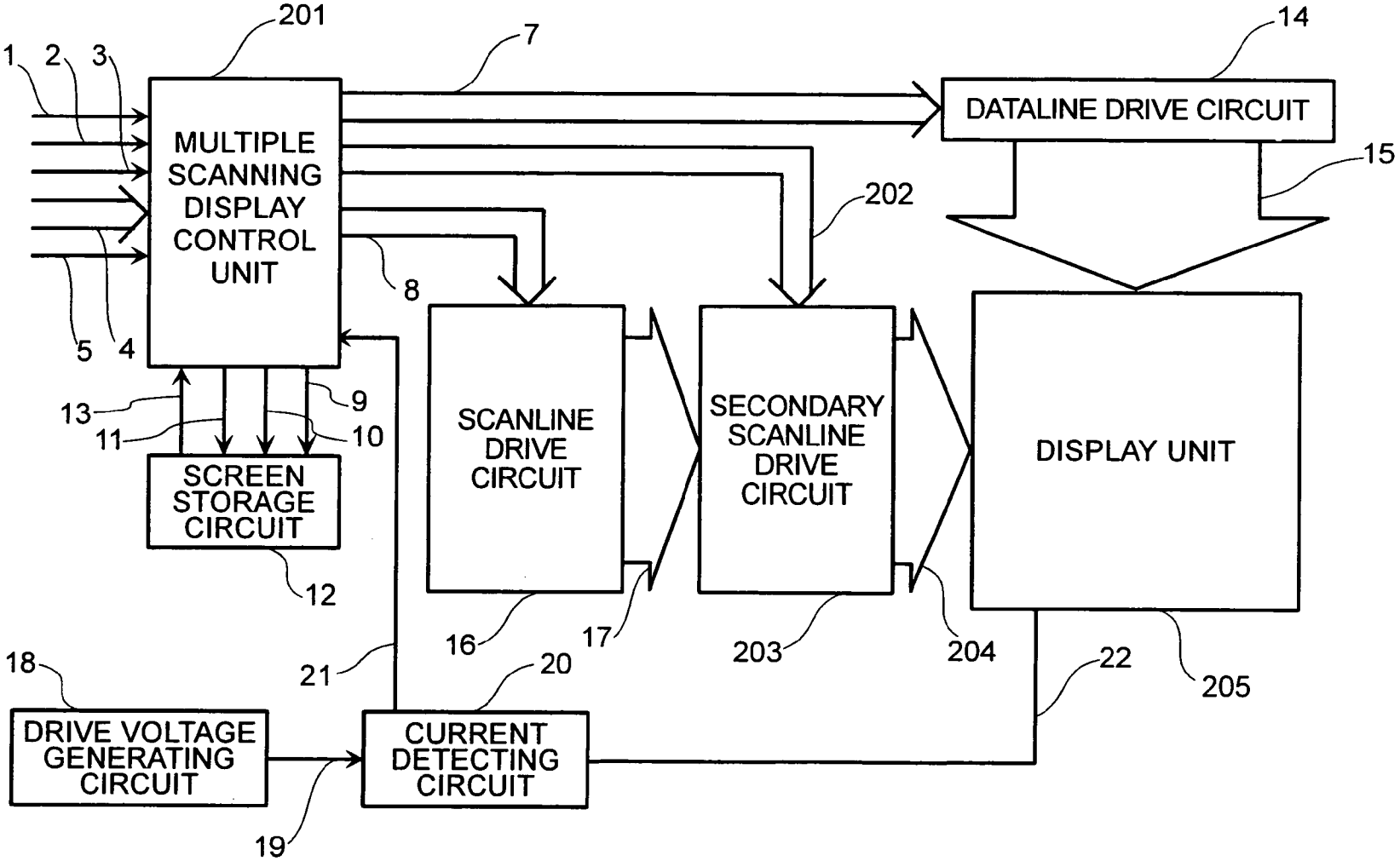
FIG. 11 is a diagram showing the configuration of a display apparatus according to a second embodiment of the present invention.

FIG. 11 is a diagram showing the configuration of a display apparatus according to the second embodiment of the present invention. It should be noted that reference numerals common to the first and second embodiments denote like components or features. Reference numeral 201 denotes a multiple display control unit, and 202 denotes secondary scanline control signals. The display control unit 201 generates the dataline control signals 7, the scanline control signals 8, the read/write command signal 9, the read/write address 10, and the data to be written 11, as in the first embodiment, and furthermore generates the secondary scanline control signals 202 for writing a black display at a timing matching the timing of the current detection information 21 after writing each piece of ordinary display data. Reference numeral 203 denotes a secondary scanline control circuit; 204 denotes scanline multiple drive signals; and 205 denotes a display unit. The secondary scanline control circuit 203 superposes each scanline drive signal 17 with a scanline drive signal produced according to the secondary scanline control signal 202 to produce each scanline multiple drive signal 204. A first multiple scanline 206 and a second multiple scanline 207 are scanned twice during a single display period.

FIG. 12 is a diagram showing a scanline multiple drive signal 204 and a dataline drive signal 15 for each scanline according to the second embodiment of the present invention. Reference numeral 208 denotes a first multiple scanning signal; 209, a first scanline display period; 210, a first scanline black display period; 211, a second multiple scanning signal; 212, a second scanline display period; 213, a second scanline black display period; 214, a third multiple scanning signal; 215, a third scanline display period; 216, a third scanline black display period; 217, a $480^{th}$ multiple scanning signal; 218, a $480^{th}$ scanline display period; and 219, a $480^{th}$ scanline black display period. Each multiple scanning signal generates a plurality of pulses (for example, two pulses) during a single display period; each multiple scanning signal includes a pulse for writing ordinary display data and an additional pulse for writing black data. This writing of black data is referred to herein as "secondary scanning drive". Reference numeral 220 denotes first scanline write data; 221, second scanline write data; 222, third scanline write data; 223, $480^{th}$ scanline write data; and 224, black write data. After ordinary display data is written for a scanline, the black write data 224 is set as the dataline drive signal and written according to the second pulse of the multiple scanning signal, that is, at the timing of the secondary scanning drive. The timing of this second pulse can be adjusted for each scanline to produce the same effect as adjusting the pixel light emission time period according to the first embodiment. That is, the period during which the black data has been written produces substantially the same effect as that of the non-light emission period of the organic EL of the first embodiment. It should be noted that the black data may be written before writing ordinary display data, or a plurality of pieces of black data may be written during a single frame period.

The multiple display control unit 201 includes a storage control unit and a multiple display control signal generating unit. The multiple display control signal generating unit generates the dataline control signals 7 and the scanline control signals 8, as in the first embodiment, and furthermore generates the secondary scanline control signals 202 for generating the scanline drive timings for writing the black data as shown in FIG. 12, according to the current detection information 21. The multiple display control signal generating unit 225 includes a basic clock generating circuit, a horizontal counter, a vertical counter, a data timing adjusting circuit, a dataline drive control circuit, a scanline drive control circuit, a scanning shift clock control circuit, a secondary scanline drive control circuit, and a secondary scanning shift clock control circuit. The secondary scanline drive control circuit generates secondary scanning start signals indicating the timing of each secondary scanning drive, according to a horizontal count value 110. The secondary scanning shift clock control circuit determines a shift amount for the secondary scanning start signal of each scanline based on the current detection information 21 and generates a secondary scanning shift clock having a cycle period corresponding to the shift amount. The secondary scanline control signals include the secondary scanning start signals and the secondary scanning shift clock.

Figure 13:
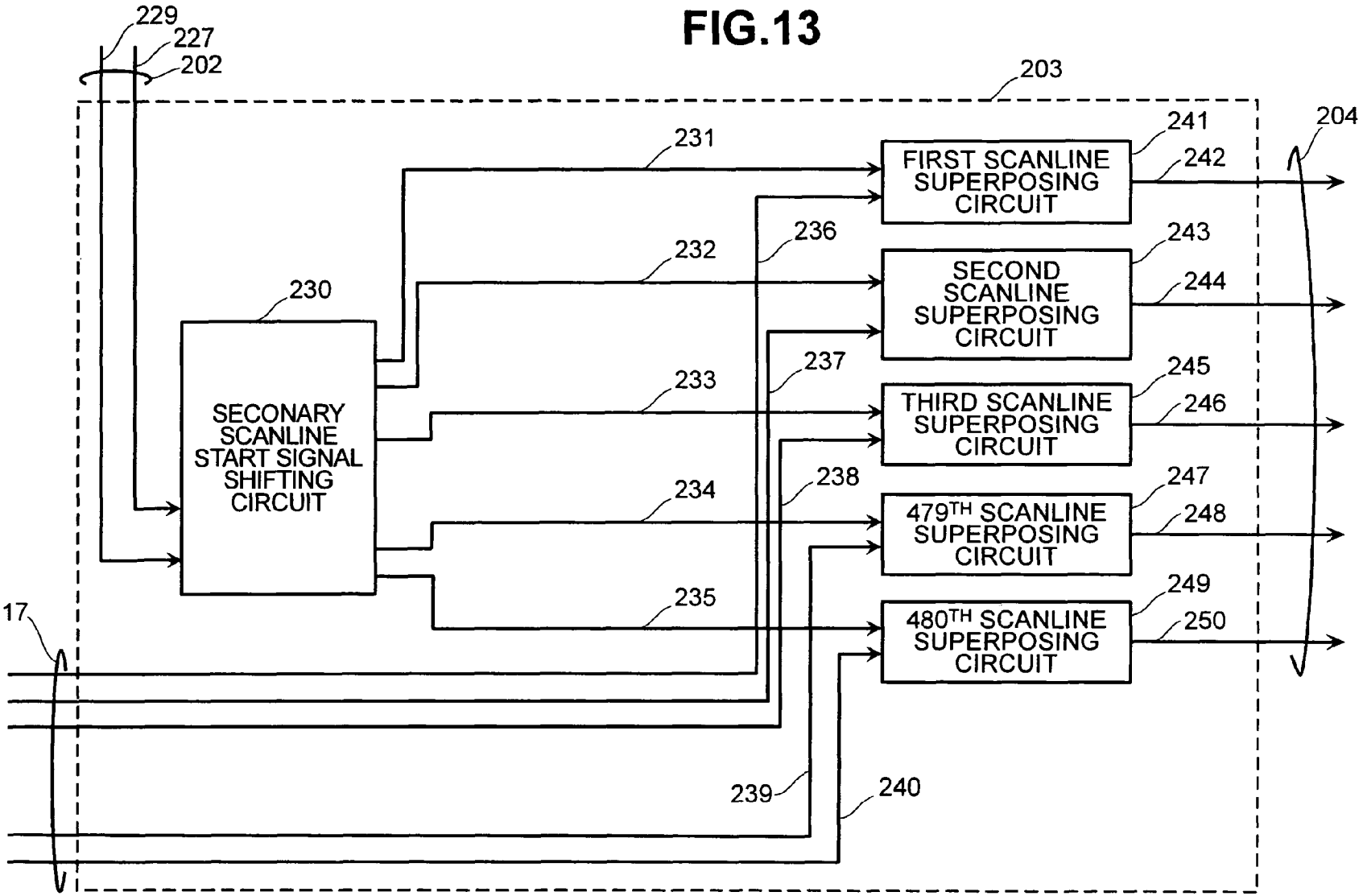
FIG. 13 is a diagram showing the internal configuration of a secondary scanline drive circuit 203 according to the second embodiment of the present invention.

FIG. 13 shows the internal configuration of the secondary scanline drive circuit 203 according to the second embodiment of the present invention. Reference numeral 230 denotes a secondary scanning start signal shifting circuit; 231, a secondary first scanline drive timing signal; 232, a secondary second scanline drive timing signal; 233, a secondary third scanline drive timing signal; 234, a secondary $479^{th}$ scanline drive timing signal; and 235, a secondary $480^{th}$ scanline drive timing signal. The secondary scanning start signal shifting circuit 230 shifts the secondary scanning start signal 227 according to the secondary scanning shift clock 229 to produce 480 secondary scanline drive timing signals (from the secondary first scanline drive timing signal 231 to the secondary $480^{th}$ scanline drive timing signal 235), each indicating the secondary drive timing of each scanline. Reference numeral 236 denotes a first scanline drive signal; 237, a second scanline drive signal; 238, a third scanline drive signal; 239, a $479^{th}$ scanline drive signal; and 240, a $480^{th}$ scanline drive signal. These signals are supplied as scanline drive signals 17. Reference numeral 241 denotes a first scanline superposing circuit; 242, a first scanline multiple drive signal; 243, a second scanline superposing circuit; 244, a second scanline multiple drive signal; 245, a third scanline superposing circuit; 246, a third scanline multiple drive signal; 247, a $479^{th}$ scanline superposing circuit; 248, a $479^{th}$ scanline multiple drive signal; 249, a $480^{th}$ scanline superposing circuit; and 250, a $480^{th}$ scanline multiple drive signal. Each scanline superposing circuit superposes a scanline drive signal with a corresponding secondary scanline drive signal to produce a single scanline multiple drive signal.

Figure 14:
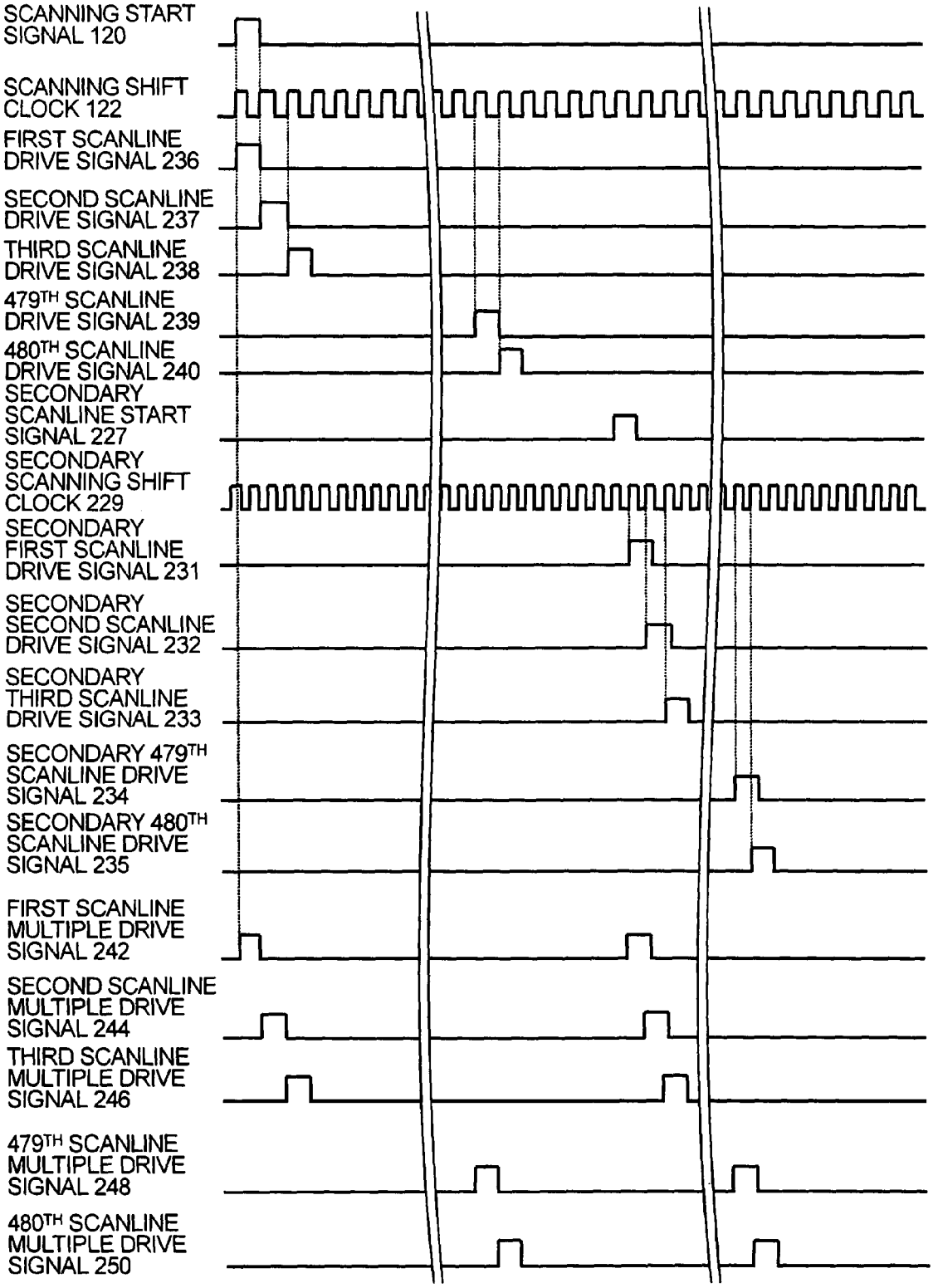
FIG. 14 is a diagram showing timings of scanline drive signals, secondary scanline drive signals, and scanline multiple drive signals according to the second embodiment of the present invention.

FIG. 14 is a diagram showing operational timings of scanline drive signals, secondary scanline drive signals, and scanline multiple drive signals. As in the first embodiment, it is arranged that the higher the position of a scanline on the screen, the longer the display period of the scanline. To accomplish this, the frequency of the secondary scanning shift clock 229 is made higher than that of the scanning shift clock 122, reducing the amount of shift of the secondary scanning drive signal for each scanline. As a result, the first scanline has the longest display period.

Description will be made below of the multiple, scanning control according to the second embodiment of the present invention with reference to FIGS. 11 to 14.

Referring to FIG. 11, the multiple display control unit 201 performs screen storage operation, dataline control signal generation operation, and scanline control signal generation operation, as in the first embodiment, and furthermore generates the secondary scanning control signals 202 for performing additional secondary scanning control after ordinary scanning control, and sets black data as the display data carried by the dataline control signals 7 at the timing of each secondary scanning operation. The secondary scanning control circuit 203 generates the secondary scanning drive signals and superposes these signals on their corresponding ordinary scanning drive signals 17 so as to produce the multiple scanning drive signals 204 for performing two scanning operations during a single frame period. Unlike the first embodiment, the pixels on the display unit 205 selected by the scanline multiple drive signals 204 are caused to emit light according to the signal voltages of the dataline drive signals 15. According to the second embodiment, as shown in FIG. 12, each time an ordinary signal voltage has been written, black data is written at a timing that varies with each scanline so as to control the pixel light emission time period of each scanline, obtaining the same effect as that produced by the first embodiment. The operations of the other components are the same as those for the first embodiment.

The operation of the multiple scanning display control unit 201 will be described in detail. The multiple display control signal generating unit generates the above secondary scanning control signals 202 based on the current detection information 21 as well as generating the dataline control signals 7, the scanline control signals 8, and the data read-out instruction signal 105. The secondary scanline drive control circuit generates the secondary scanning start signal 227, used as a reference for each secondary scanning drive, after ordinary write operation, as shown in FIG. 12. The secondary scanning shift clock control circuit generates the secondary scanning shift clock for shifting the secondary scanning start signal.

The secondary scanning start signal shifting circuit 230 shifts the secondary scanning start signal 227 according to the secondary scanning shift clock 229 to produce the secondary scanning drive signal for each scanline as shown in FIG. 13. Lastly, each scanline superposing circuit superposes a scanning drive signal with a corresponding secondary scanning drive signal to produce a multiple scanning drive signal for performing two scanning operations during a single frame period, as shown in FIG. 14. At that time, the frequency of the secondary scanning shift clock 229 can be set different from that of the scanning shift clock 122 to change the display period of each scanline. Accordingly, this frequency may be adjusted according to the current detection information 21, making it possible to adjust the display period to compensate for the voltage drop as in the first embodiment.

It should be noted that instead of inserting black data, display data having a luminance level lower than that of the original display data may be inserted.

The second embodiment described above can substantially control the light emission/non-light emission period of each organic EL 44 without employing the light emission control switch 43 and light emission control lines for each pixel (for example, the first light emission control line 30, the $480^{th}$ light emission control line 31, etc.), producing the effect of simplifying the configuration of each pixel as well as producing the effect of the first embodiment. It should be noted that the light emission control switch 43 may be provided in each pixel to serve a purpose other than to control the organic EL 44.

The present invention may be applied to not only light-emitting element displays but also liquid crystal displays and plasma displays.

What is claimed is:

1. A display device comprising:

a plurality of display elements arranged in a matrix form;

a drive voltage generation circuit for generating a drive voltage that is applied to the display elements;

a plurality of drive voltage supply lines displaced side by side in the matrix form to supply a voltage generated by the drive voltage generation circuit to the display elements, wherein a fixed drive voltage is supplied to each of the drive voltage supply lines by the drive voltage generation circuit, which fixed drive voltage decreases along the drive voltage supply lines due to wiring resistance as a function of distance from the drive voltage generation circuit;

a data line drive circuit for generating a signal voltage for controlling a current of the display elements corresponding to inputted display data;

a scan line drive circuit for selecting one of the display elements to be applied with the signal voltage;

a detection circuit for detecting the current of the selected display element corresponding to the inputted display data; and a light emission control circuit for turning ON or OFF the current of the selected display element to control the light emission period of the selected display element based on a distance from the drive voltage generation circuit to the selected display element, said distance being determined by the amount of drive voltage at the selected display element, which drive voltage corresponds to the fixed drive voltage supplied by the drive voltage generation circuit decreased by an amount corresponding to wiring resistance between the selected display element and the drive voltage generation circuit, and a detection result of the current of the display element, to control a light emission period in a frame period, such that the light emission period is increased among said display elements in accordance with increasing the distance from the drive voltage generation circuit to each of the display elements, and such that, between any two display elements along the same drive voltage supply line applied with the fixed drive voltage, the light emission period will be longer for the display element which is located at a greater distance from the drive voltage generation circuit than for the other display element, wherein an increment rate, a voltage drop and a slope of the light emission period corresponding to the distance from the drive voltage generation circuit to one of the display elements in a case where the current of the display elements which are on the same drive voltage supply line has a first current level is larger than an increment rate, a voltage drop and a slope of the light emission period corresponding to the distance from the drive voltage generation circuit to another one of the display elements in a case where the current of the display elements which are on the same drive voltage supply line has a second current level which is smaller than the first current level.

2. The display device as claimed in claim 1, wherein the current of the display element in a case where the display element displays white display data is larger the current of the display element in a case where the display element displays intermediate display data.

3. The display device as claimed in claim 1, wherein the light emission control circuit controls the light emission period in a unit where the scan line drive circuit selects the display element.

4. The display device as claimed in claim 1, wherein the light emission control circuit inserts black display data into the inputted display data and controls a timing or a time when the black display data is inserted into the inputted display data to control the light emission period, instead of turning ON or OFF the current of the display element.

5. The display device as claimed in claim 1, wherein the light emission control circuit inserts low intensity display data into the inputted display data and controls a timing or a time when the low intensity display data is inserted into the inputted display data to control the light emission period, instead of turning ON and OFF the current of the display element.

6. The display device as claimed in claim 1, wherein the display element includes a light emission element, a capacitance element that stores electrical charge corresponding to the signal voltage, a drive element that flows a current corresponding to the electrical charge in the capacitance element and a switch that turns ON and OFF the current of the display element, wherein the current corresponding to the electrical charge in the capacitance element is the current of the display element.

7. The display device according to claim 1, wherein the light emission control circuit is configured to provide initial values of the light emission period for each of the display elements based on the distance of each display element from the drive voltage generation circuit and to provide timing adjustment amounts to the initial values of the light emission period of each of the display elements based upon detection results of the current of the display element determined by the detection circuit when the display element is selected to be applied with the signal voltage by the scan line drive circuit.

8. The display device according to claim 1, wherein the light emission control circuit is located between the scan line drive circuit and the display elements.

* * * * *